US005753399A

United States Patent [19]

Hayase et al.

[11] Patent Number: 5,753,399

[45] Date of Patent: May 19, 1998

[54] TONER FOR DEVELOPING ELECTROSTATIC IMAGE CONTAINING CROSSLINED STYRENE COPOLYMER AND A NEW-CROSSLINKED OR CROSSLINKED POLYESTER RESIN

[75] Inventors: Kengo Hayase, Toride; Tatsuya Nakamura, Tokyo; Tatsuhiko Chiba, Kamakura, all of Japan

[73] Assignee: Canon Kabushiki Kaisha, Tokyo, Japan

[21] Appl. No.: 647,727

[22] Filed: May 15, 1996

[30] Foreign Application Priority Data

May 15, 1995 [JP] Japan ..... 7-138850

[51] Int. Cl.[6] ..... G03G 9/087

[52] U.S. Cl. ..... 430/109; 430/110

[58] Field of Search ..... 430/109, 110

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 5,124,225 | 6/1992 | Shibata | 430/109 |
| 5,362,593 | 11/1994 | Inoue et al. | 430/111 |

FOREIGN PATENT DOCUMENTS

| | | | |
|---|---|---|---|
| 0516153 | 12/1992 | European Pat. Off. | G03G 9/08 |
| 0618511 | 10/1994 | European Pat. Off. | G03G 9/07 |
| 4139193 | 4/1992 | Germany | G03G 9/087 |
| 36-10231 | 7/1961 | Japan . | |
| 59-53856 | 3/1984 | Japan | G03G 9/08 |
| 59-61842 | 4/1984 | Japan | G03G 9/08 |
| 62-106473 | 5/1987 | Japan | G03G 9/08 |
| 63-186253 | 8/1988 | Japan | G03G 9/08 |
| 1-128071 | 5/1989 | Japan | G03G 9/08 |
| 4-353866 | 12/1992 | Japan | G03G 9/087 |
| 6-59504 | 3/1994 | Japan | G03G 9/087 |

OTHER PUBLICATIONS

Sperling, LH. Introduction to Physical Polymer Science. New York: John-Wiley & Sons, pp. 230 & 236–238, 1986.

Grant, Roger & Claire Grant. Grant & Hackh's Chemical Dictionary. New York: McGraw-Hill, Inc. p. 116, 1987.

*Primary Examiner*—Christopher D. Rodee

*Attorney, Agent, or Firm*—Fitzpatrick, Cella, Harper & Scinto

[57] ABSTRACT

A toner for developing an electrostatic image includes: 100 wt. parts of a binder resin, 1–150 wt. parts of a colorant and a relatively large amount of 5–40 wt. parts of a low-softening point substance. The toner is further characterized by viscoelastic properties including: a storage modulus at 60° C. ($G'_{60}$) and a storage modulus at 80° C. ($G'_{80}$) providing a ratio ($G'_{60}/G'_{80}$) of at least 80, and a storage modulus at 155° C. ($G'_{155}$) and a storage modulus at 190° C. ($G'_{190}$) providing a ratio ($G'_{155}/G'_{190}$) of 0.95–5. As a result, the toner shows good low-temperature fixability and anti-offset characteristic, and also little temperature-dependence of gloss.

28 Claims, 7 Drawing Sheets

TONER FOR DEVELOPING ELECTROSTATIC IMAGE CONTAINING CROSSLINED STYRENE COPOLYMER AND A NEW-CROSSLINKED OR CROSSLINKED POLYESTER RESIN

FIELD OF THE INVENTION AND RELATED ART

The present invention relates to a toner for developing electrostatic images used in image forming methods, such as electrophotography or electrostatic recording, particularly a toner suitable for heat and pressure fixation, and also an apparatus unit including the toner and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being directly or indirectly transferred onto a transfer(-receiving) material such as paper etc., as desired, fixed by heating, pressing, or heating and pressing, or with solvent vapor to obtain a copy or print carrying a fixed toner image. A portion of the toner remaining on the photosensitive member without being transferred is cleaned by various means, and the above mentioned steps are repeated for a subsequent cycle of image formation.

As for the step of fixing the toner image onto a sheet material such as paper which is the final step in the above process, various methods and apparatus have been developed, of which the most popular one is a heat and pressure fixation system using hot rollers.

In the heat and pressure fixation system using hot rollers, a transfer material carrying a toner image to be fixed is passed through the hot rollers, while a surface of a hot roller having a releasability with the toner is caused to contact the toner image surface of the transfer material under pressure, to fix the toner image. In this method, as the hot roller surface and the toner image on the transfer material contact each other under a pressure, a very good heat efficiency is attained for melt-fixing the toner image onto the transfer material to afford quick fixation.

Different toners are used for different models of copying machines and printers. The difference primarily arises from differences in fixing speed and fixing temperature. More specifically, as the heating roller surface and the toner image in a molten state contact each other under pressure, the fixability and the gloss of a resultant fixed image are greatly affected by the fixing speed and temperature. Generally, the heating roller surface temperature is set to be lower in case of a slow fixing speed and set to be higher in case of a fast fixing speed. This is because a substantially constant heat quantity has to be supplied from a heating roller to the toner in order to fix the toner to a transfer material regardless of a difference in fixing speed.

In case where a different quantity of heat is supplied to the transfer material, a different gloss is provided to the resultant image. For example, when a transfer material is passed through a fixing device, the heating roller temperature is gradually lowered to result in a difference in heat quantity between the leading end and the trailing end of the transfer material, so that a gloss difference arises between the ends of a resultant image. This is liable to provide an awkward impression especially in a full-color image. Further, in the case of continuous image formation on a large number of sheets, a lowering in temperature of the heating roller is caused, whereby a difference in gloss can occur between the images formed at the initial stage and the images formed at the final stage of the continuous image formation in some cases.

In order to solve the above-mentioned problem, there has been proposed to use a crosslinked binder resin so as to suppress the fluidization in a molten state. However, as the crosslinking degree of binder resin is increased, the quick meltability of the toner is lowered so that the toner cannot be readily fixed unless the heating roller temperature is sufficiently high. Accordingly, as fixation performances, there has been desired a toner capable of allowing a low-temperature fixation and providing images of a constant gloss over a wide temperature region.

Japanese Laid-Open Patent Application (JP-A) 1-128071 has disclosed a toner for developing electrostatic images comprising a polyester resin as a binder resin and a specific storage modulus at 95° C. However, it has been further desired to provide a toner showing a smaller lowering in storage modulus in a temperature range of 60°–80° C., providing fixed images of a more uniform gloss and showing a better low-temperature fixability.

JP-A 4-353866 has disclosed a toner for electrophotography having rheological properties including a storage modulus lowering initiation temperature in the range of 100°–110° C., a specific storage modulus at 150° C. and a loss modulus peak temperature of at least 125° C. However, the storage modulus lowering initiation temperature is too high and the loss modulus peak temperature is too high, so that it is necessary to improve the low-temperature fixability.

JP-A 6-59504 has disclosed a toner composition comprising a polyester resin of a specific structure as a binder resin. The toner composition is also characterized by a specific storage modulus at 70°–120° C. and a specific loss modulus at 130°–180° C. Because the toner does not contain a low-softening point substance as an essential component, the toner has an inferior low-temperature fixability and is liable to cause a remarkable change in storage modulus in a temperature region of 155° C. or higher, thus being liable to result in a gloss change.

Further, a copying machine or a printer for full-color image formation is becoming to be used. A full-color image is generally formed through a process as follows. A photosensitive member is uniformly charged by a primary charger and is exposed imagewise with laser light modulated by a magenta image signal based on an original to form an electrostatic image on the photosensitive member, which is developed by using a magenta developing device containing a magenta toner to form a magenta toner image. The magenta toner image on the photosensitive member is then transferred to a transferred material conveyed thereto directly or indirectly via an intermediate transfer member.

The photosensitive member after developing of the electrostatic image and transfer of the toner image is charge-removed by a charge-removing charger, cleaned by a cleaning means and then again charged by the primary charger, followed by a similar process for formation of a cyan toner image and transfer of the cyan toner image onto the transfer material having received the magenta toner image. Further, similar development is performed with respect to yellow color and black color, thereby to transfer four-color toner images onto the transfer material. The transfer material carrying the four-color toner images is subjected to fixation under application of heat and pressure by a fixing means to form a full-color image.

In recent years, an image-forming apparatus performing an image forming method as described above not only is used as a business copier for simply reproducing an original but also has been used as a printer, typically a laser beam printer, for computer output and a personal copier for individual users.

In addition to such uses as representatively satisfied by a laser beam printer, the application of the basic image forming mechanism to a plain paper facsimile apparatus has been remarkably developed.

For such uses, the image forming apparatus has been required to be smaller in size and weight and satisfy higher speed, higher quality and higher reliability. Accordingly, the apparatus has been composed of simpler elements in various respects. As a result, the toner used therefor is required to show higher performances so that an excellent apparatus cannot be achieved without an improvement in toner performance. Further, in accordance with various needs for copying and printing, a greater demand is urged for color image formation, and a higher image quality and a higher resolution are required for faithfully reproducing an original color image. In view of these requirements, a toner used in such a color image forming method is required to exhibit good color-mixing characteristic on heating.

In the case of a fixing device for a color image forming apparatus, a plurality of toner layers including those of magenta toner, cyan toner, yellow toner and black toner, are formed on a transfer-receiving material, so that the offset is liable to be caused as a result of an increased toner layer thickness.

Hitherto, in order to prevent the attachment of a toner onto a fixing roller surface, it has been practiced to compose the roller surface of a material, such as a silicone rubber or a fluorine-containing resin, showing excellent releasability against a toner, and coat the roller surface with a film of a liquid showing a high releasability, such as silicone oil or a fluorine-containing oil, for the purpose of preventing offset and deterioration of the roller surface. However, such a measure, though very effective for preventing toner offset, requires an equipment for supplying the offset-preventing liquid and complicates the fixing device.

The transfer(-receiving) material carrying a toner image to be fixed by such a fixing device may generally comprise various types of paper, coated paper, and plastic film. In recent years, transparency films for an overhead projector (OHP films) have been frequently used for presentation, etc. An OHP film, unlike paper, has a low oil-absorption capacity and carries a substantial amount of oil on the OHP film after fixation. Silicone oil is liable to be evaporated on heat application to soil the interior of the apparatus and requires a necessity of treating the recovered oil. Accordingly, based on a concept of dispensing with a silicone oil applicator and supplying an offset-preventing liquid from the inside of the toner on heating, it has been practiced to add a release agent, such as low-molecular weight polyethylene or low-molecular weight polypropylene in the toner. However, in case where such a release agent is added in a large quantity so as to exhibit a sufficient effect, the release agent is liable to cause a filming onto the photosensitive member surface and soil the surface of a carrier or a developing sleeve, thus causing image deterioration. Accordingly, it has been practiced to incorporate in the toner a release agent in a small amount not causing image deterioration and supplying a small amount of a release oil or clean the toner attached onto the fixing roller by a winding-up type cleaning web or a cleaning pad.

However, in view of recent demand for a further smaller, lighter and more reliable apparatus, it is preferred to dispense with even such auxiliary means.

Further, in a full-color image forming apparatus using non-magnetic color toners, a two-component type developer comprising a non-magnetic color toner and a magnetic carrier is generally used to develope electrostatic images according to the magnetic brush developing scheme. In the magnetic brush developing method using a two-component type developer, it is necessary to adjust a constant mixing ratio between the toner and the carrier, so that the developing device equipped with such means is liable to be large in size. Accordingly, in order to provide a small-size full-color image forming apparatus, it is desirable to use a developing device (apparatus unit) capable of developing electrostatic images according to the non-magnetic mono-component developing scheme, e.g., as shown in FIG. 6, which however requires a non-magnetic color toner that can exhibit a continuous image forming characteristic for a large number of sheets while enduring a pressure and abrasion by a toner application roller 18 and an elastic blade 19, is less liable to cause offset even when fixed by using a heating roller not supplied with an offset-presenting liquid and exhibits good color mixing characteristic.

SUMMARY OF THE INVENTION

A generic object of the present invention is to provide a toner for developing electrostatic images having solved the above-mentioned problems.

A more specific object of the present invention is to provide a toner for developing electrostatic images having excellent low-temperature fixability and anti-offset characteristic and also a moderate gloss value.

Another object of the present invention is to provide a non-magnetic color toner suitable for the non-magnetic monocomponent-type development scheme and exhibiting excellent continuous image forming characteristic on a larger number of sheets.

Another object of the present invention is to provide a non-magnetic color toner having moderate gloss value and color-mixing characteristic.

Another object of the present invention is to provide a non-magnetic color toner suitable for the oil-less heat and pressure fixation scheme.

A further object of the present invention is to provide an apparatus unit including a toner as described above.

A still further object of the present invention is to provide an image forming method using a toner as described above.

Another object of the present invention is to provide an image forming method for forming multi-color or full-color images including an oil-less heat and pressure fixation scheme.

Another object of the present invention is to provide an image forming method for forming multi-color or full-color images including a non-magnetic mono-component developing step using a non-magnetic color toner.

According to the present invention, there is provided a toner for developing an electrostatic image, comprising: 100 wt. parts of a binder resin, 1–150 wt. parts of a colorant and 5–40 wt. parts of a low-softening point substance; wherein the toner has a storage modulus at 60° C. ($G'_{60}$) and a storage modulus at 80° C. ($G'_{80}$) providing a ratio ($G'_{60}/G'_{80}$) of at least 80, and a storage modulus at 155° C. ($G'_{155}$) and a storage modulus at 190° C. ($G'_{190}$) providing a ratio ($G'_{155}/G'_{190}$) of 0.95–5.

According to another aspect of the present invention, there is provided an apparatus unit, detachably mountable to an apparatus main assembly, comprising: the above-mentioned toner, a developing sleeve, a toner application means disposed to press the developing sleeve, and an outer casing for enclosing the toner, the developing sleeve and the toner application means.

According to a further aspect of the present invention, there is provided an image forming method, comprising:

forming an electrostatic image on an image-bearing member, developing the electrostatic image with the above-mentioned toner having a triboelectric charge to form a toner image, transferring the toner image onto a transfer material via or without via an intermediate transfer member, and fixing the toner image onto the transfer member under application of heat and pressure.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
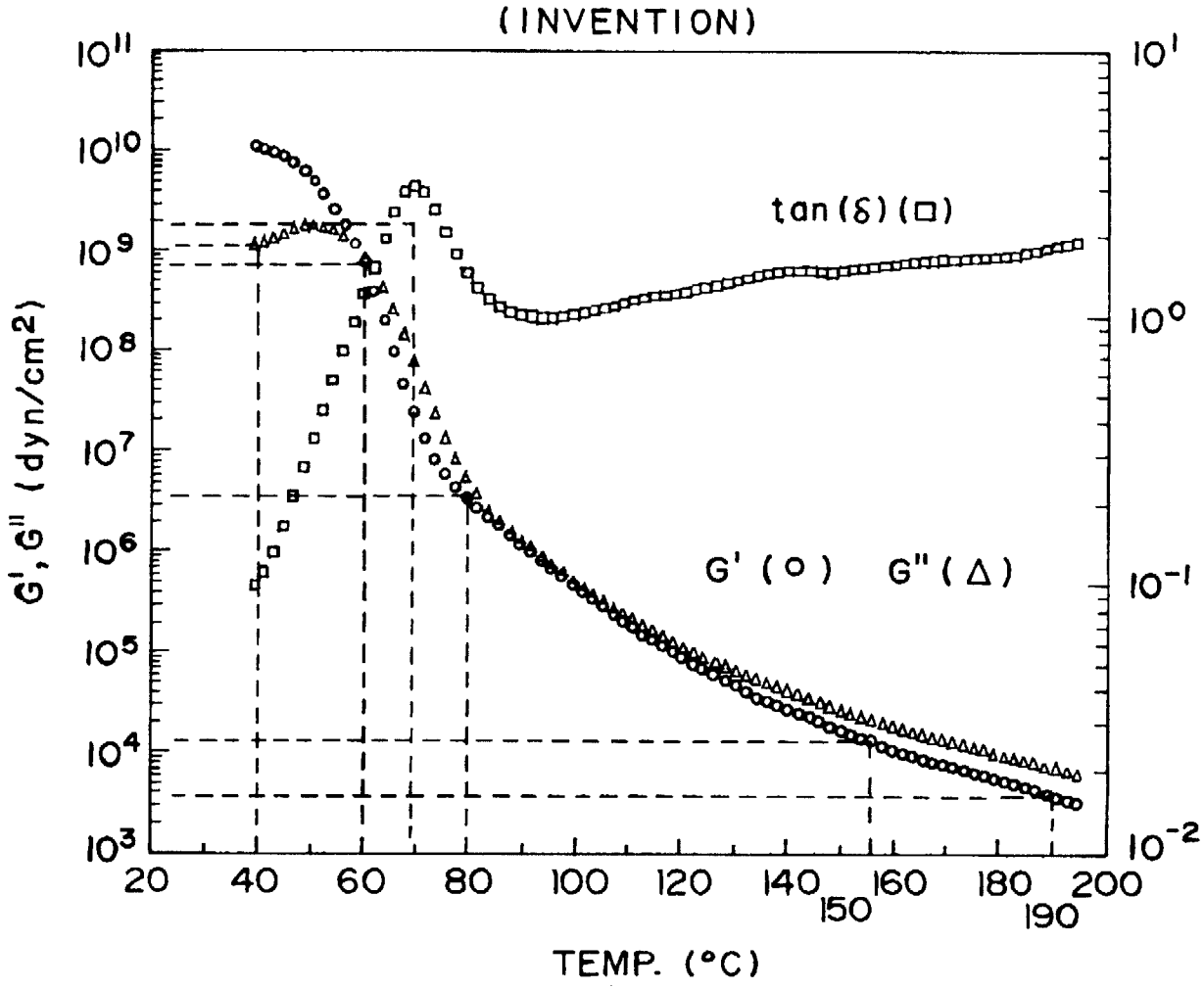
FIG. 1 is a graph showing a storage modulus curve, a loss modulus curve and a tan (δ) curve of a toner according to the invention.

The toner for developing electrostatic images according to the present invention accomplishes a low-temperature fixability and a suppression of gloss (value) change at different fixing temperatures by satisfying characteristic viscoelasticities including a storage modulus at 60° C. ($G'_{60}$) and a storage modulus at 80° C. ($G'_{80}$) providing a ratio ($G'_{60}/G'_{80}$) of at least 80, and a storage modulus at 155° C. ($G'_{155}$) and a storage modulus at 190° C. ($G'_{190}$) of 0.95–5.0.

In the toner of the present invention, $G'_{60}$, $G'_{80}$ and ratio ($G'_{60}/G'_{80}$) represent combined storage modulus characteristics of the binder resin and low-softening point substance in a state of transition from a glass state or glass transition state where deformation is not readily caused by an external stress to a deformable state. A ratio ($G'_{60}/G_{80}$) of at least 80 means that the toner causes an abrupt lowering in elasticity in the course of heating from 60° C. to 80° C., and allows good low-temperature fixation in the heating and pressing fixation step, so that the toner image can be well fixed onto a transfer material from immediately after a start of power supply to an apparatus main body in a cold environment. The ratio ($G'_{60}/G'_{80}$) may preferably be 100 to 400, more preferably 150 to 300.

Further, the toner according to the present invention contains 5–40 wt. parts, preferably 12–35 wt. parts, of a low-softening point substance, per 100 wt. parts of a binder resin, i.e., a larger proportion than in a conventional toner for heat-pressure fixation, so that the low-temperature fixability can be further improved. In the case of a non-magnetic toner, the low-softening point substance may preferably be contained in a proportion of 11–30 wt. % of the toner. In the case of a low-softening point substance having a releasability, such as wax, the offset phenomenon can be well suppressed because of an improved high-temperature offset characteristic, even if an offset-preventing agent, such as silicone oil, is not applied onto the heating roller surface.

The toner according to the present invention may preferably show a $G'_{60}$ of $1\times10^8$–$1\times10^{10}$ dyn/cm$^2$, more preferably $2\times10^8$–$9\times10^9$ dyn/cm$^2$, further preferably $3\times10^8$–$5\times10^9$ dyn/cm$^2$, so as to exhibit good continuous image forming characteristic on a large number of sheets while enduring pressure and abrasion in the developing device.

It is further preferred that the toner according to the present invention provides a loss modulus curve showing a maximum ($G''_{max}$) of at least $1\times10^9$ dyn/cm$^2$, more preferably $1\times10^9$–$1\times10^{10}$ dyn/cm$^2$, in a temperature range of 40°–65° C., so as to exhibit improved anti-blocking performance and continuous image forming characteristic. It is further preferred to show a loss modulus at 40° C. ($G''_{40}$) giving a ratio ($G''_{max}/G''_{40}$) of at least 1.5.

There is generally found a correlation between the storage modulus of a toner at a fixing temperature and a gloss value of the fixed image. For example, a higher toner storage modulus provides a lower gloss value of a fixed toner image, and a lower temperature-dependent change in storage modulus results in a smaller change in gloss value. Accordingly, the ratio ($G'_{155}/G'_{190}$) provides an effective measure for evaluating the degree of gloss value change of fixed toner images corresponding to a change in fixing temperature around 180° C.

The $G'_{155}/G'_{190}$ of the toner according to the present invention is set to be in the range of 0.95–5, more preferably 1–5, so as to provide a smaller gloss value change in response to a fixing temperature change. Further, in order to provide a color-mixing characteristic while retaining the anti-offset characteristic, the toner may preferably have $G'_{190}$ of $1\times10^3$–$1\times10^4$ dyn/cm$^2$.

In order to provide a better anti-offset characteristic and a smaller gloss change in fixed images, the binder resin may preferably have a tetrahydrofuran-insoluble matter content (THF-insoluble content) of 0.1–20 wt. %, more preferably 1–15 wt. %.

The binder resin for the toner of the present invention may for example comprise: polystyrene; homopolymers of styrene derivatives, such as poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; acrylic resin, methacrylic resin, polyvinyl acetate, silicone resin, polyester resin, polyamide resin, furan resin, epoxy resin and xylene resin. These resins may be used singly or in combination of two or more species.

As a principal component of the binder resin, it is preferred to use a styrene copolymer which is a copolymer of styrene and another vinyl monomer, in view of the developing and fixing performances.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is preferred that the styrene copolymer is crosslinked with a crosslinking agent, such as divinylbenzene, in order to provide the resultant toner with a broader fixable temperature region and an improved anti-offset characteristic.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylanilene, divinyl ether, divinyl sulfide and divinylsulfone; and compounds having three or more vinyl groups. These may be used singly or in mixture.

In the case of using a binder resin comprising principally a crosslinked styrene copolymer, the binder resin may preferably contain a THF-soluble component providing a molecular weight distribution according to gel permeation chromatograph (GPC) showing a main peak in a molecular weight region of $3\times10^3$–$5\times10^4$ and a sub-peak or shoulder in a molecular weight region of at least $10^5$. It is further preferred to have totally 2 or more sub-peak(s) and/or shoulder(s) in the molecular weight region of at least $10^5$. The binder resin comprising principally a styrene copolymer may preferably contain a THF-insoluble content of 0.1–20 wt. %, preferably 1–15 wt. %.

The THF-insoluble content refers to a weight percentage of an ultra high-molecular weight polymer component (substantially a crosslinked polymer) insoluble in solvent THF. The THF insoluble content referred to herein is based on values measured in the following manner.

0.5–1.0 g of a toner sample is weighed (at $W_1$ g) and placed in a cylindrical filter paper (e.g., "No. 86R", available from Toyo Roshi K.K.), which is mounted on a Soxhlet's extractor. Then, the sample is subjected to 6 hours of extraction with 100–200 ml of solvent THF, and the soluble content extracted with THF is subjected to evaporation of THF and dried under vacuum for several hours at 100° C. to be weighed (at $W_2$ g). Based on the measured values and the weight ($W_3$ g) of the components, such as the pigment and the wax, other than the resin component, the THF insoluble content is calculated by the following equation:

$$THF \text{ insoluble content (wt. \%)}=\{[W_1-(W_3+W_2)]/(W_1-W_3)\}\times100$$

In the case of a binder resin comprising a polyester resin, the binder resin may preferably have such a molecular weight distribution that it shows at least one peak in a molecular weight region of $3\times10^3$–$5\times10^4$ and contains 60–100 wt. % of a component having a molecular weight of at most $10^5$. It is further preferred that at least one peak is present in a molecular weight region of $5\times10^3$–$2\times10^4$.

It is also preferred to use a styrene copolymer and a polyester resin in mixture. For example, it is preferred to use a combination of a crosslinked styrene copolymer and a non-crosslinked polyester resin, or a combination of a crosslinked styrene copolymer and a crosslinked polyester resin in view of the fixability, anti-offset characteristic and color-mixing performance of the toner.

A polyester resin is excellent in fixability and clarity and is suitable for a color toner requiring a good color mixing characteristic.

It is particularly preferred to use a non-crosslinked or crosslinked polyester resin obtained by copolycondensation between a bisphenol derivative represented by the formula of:

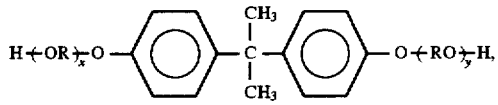

wherein R denotes an ethylene or propylene group, x and y are independently a positive integer of 1 or larger with the proviso that the average of x+y is in the range of 2–10, or a substitution thereof, and a carboxylic acid component comprising a carboxylic acid having at least two carboxylic groups, or an acid anhydride or a lower alkyl ester thereof, such as fumaric acid, maleic acid, maleic anhydride, phthalic acid, terephthalic acid, trimellitic acid or pyromellitic acid.

The polyester resin may preferably have an acid value (AV) of 1–35 mgKOH/g, more preferably 1–20 mgKOH/g, further preferably 3–15 mgKOH/g, so as to provide a stable toner chargeability under various environmental conditions.

Examples of the low-softening point substance used in the toner for developing electrostatic images according to the present invention may include: paraffin wax, polyolefin wax, microcrystalline wax, polymethylene wax such as Fischer-Tropshe wax, amide wax, higher aliphatic acid, long-chain alcohol, ester wax, and derivatives thereof such as grafted products and block compounds. It is preferred to remove a low-molecular weight fraction from the low-softening point substance to provide a DSC heat absorption curve having a sharp maximum heat-absorption peak.

Preferred examples of the wax (low-softening point substance) may include: linear alkyl alcohols, linear aliphatic acids, linear acid amides, linear esters and montane derivatives each having 15–100 carbon atoms. It is also preferred to remove impurities, such as liquid aliphatic acid from the waxes in advance.

A preferred class of the wax component used in the present invention may include a low-molecular weight alkylene polymer wax obtained through polymerization of an alkylene by radical polymerization under a high pressure or in the presence of a Ziegler catalyst under a low pressure; an alkylene polymer obtained by thermal decomposition of an alkylene polymer of a high molecular weight; a fractionation product obtained by fractionating a low-molecular alkylene polymer by-produced in alkylene polymerization, and a polymethylene wax obtained by removing a distribution residue from the Arge process for converting a gas mixture of carbon monoxide and hydrogen to form a hydrocarbon polymer and extracting a particular fraction from the distillation residue as it is or after hydrogenation. These waxes may contain an anti-oxidant added thereto.

The low-softening point substance used in the present invention may preferably have a heat-absorption main peak in a temperature region of 40°–90° C., more preferably 45°–85° C., on its DSC heat-absorption curve. The low-softening point substance may preferably be one showing a sharp-melting characteristic peak as represented by the heat-absorption main peak having a half-value width of at most 10° C., more preferably at most 5° C. The low-softening point substance may particularly preferably comprise an ester wax comprising principally an ester compound between a long-chain alkyl alcohol having 15–45 carbon atoms and a long-chain alkyl carboxylic acid having 15–45 carbon atoms.

Examples of the black colorant used in the present invention may include: carbon black, a magnetic material, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the binder resin. A black colorant comprising a magnetic material, unlike the other colorants, may preferably be used in a proportion of 40–150 wt. parts per 100 wt. parts of the binder resin.

The charge control agent used for stabilizing the triboelectric chargeability of the toner may include known charge control agents. The charge control agent may preferably be one which is colorless and has a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids such as salicylic acid, alkylsalicylic acid, dialkylsalicylic acid, naphtoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent used in the present invention may preferably be used in a proportion of 0.5–10 wt. parts per 100 wt. parts of the binder resin. However, the charge control agent is not an essential component for the toner particles used in the present invention. The charge control agent can be used as an optional additive in some cases. In the case of using two-component developing method, it is possible to utilize triboelectric charge with a carrier. In the case of using a non-magnetic one-component blade coating developing method, it is possible to omit a charge control agent by positively utilizing a triboelectric charge through friction with a blade member or a sleeve member.

As a process for producing a toner according to the present invention, there may be adopted a pulverization process wherein the binder resin, the colorant, the low-softening point substance and other optional additives such as a charge control agent and other internal additives are uniformly kneaded and dispersed by a pressure kneader, an extruder or a media disperser, and the kneaded product is mechanically pulverized or caused to impinge onto a target in a jet stream to be pulverized into a desired toner particle size level, followed by classification into a narrower particle size distribution to form toner particles. In addition, it is also possible to adopt a process for directly producing toner particles according to suspension polymerization as disclosed in JP-B 36-10231, JP-A 59-53856, and JP-A 59-61842; a boundary association process wherein fine particles of at least one species are agglomerated into a desired particle size as disclosed in JP-A 62-106473 and JP-A 63-186253; a dispersion polymerization process for directly producing toner particles in an aqueous organic solvent in which the monomer is soluble but the resultant polymer is insoluble; and a process for producing toner particles according to emulsion polymerization as represented by soap-free polymerization wherein toner particles are directly formed by polymerization in the presence of a water-soluble polymerization initiator.

In a type of the pulverization process, binder resins of a high molecular weight and a low molecular weight are blended, and optionally modified by changing the species and addition amount of a low-softening point substance. This process is particularly effective in the case of using binder resins having a hydroxyl group or a carboxylic group, and it is possible to cause a metallic crosslinking by adding an organometallic compound or its derivative at the time of kneading, thereby producing a THF-insoluble component. In the polymerization process for toner particle production, it is preferred to incorporate in an appropriate monomer an appropriate crosslinking agent and/or resin component, and also a low-softening point substance and a polymerization initiator; form the resultant polymerizable monomer composition into particles; and polymerize the particles of the composition, to form polymerizate particles (toner particles) in which the low-softening point substance is enclosed within the polymerized binder in a sea-island structure.

Figure 7:
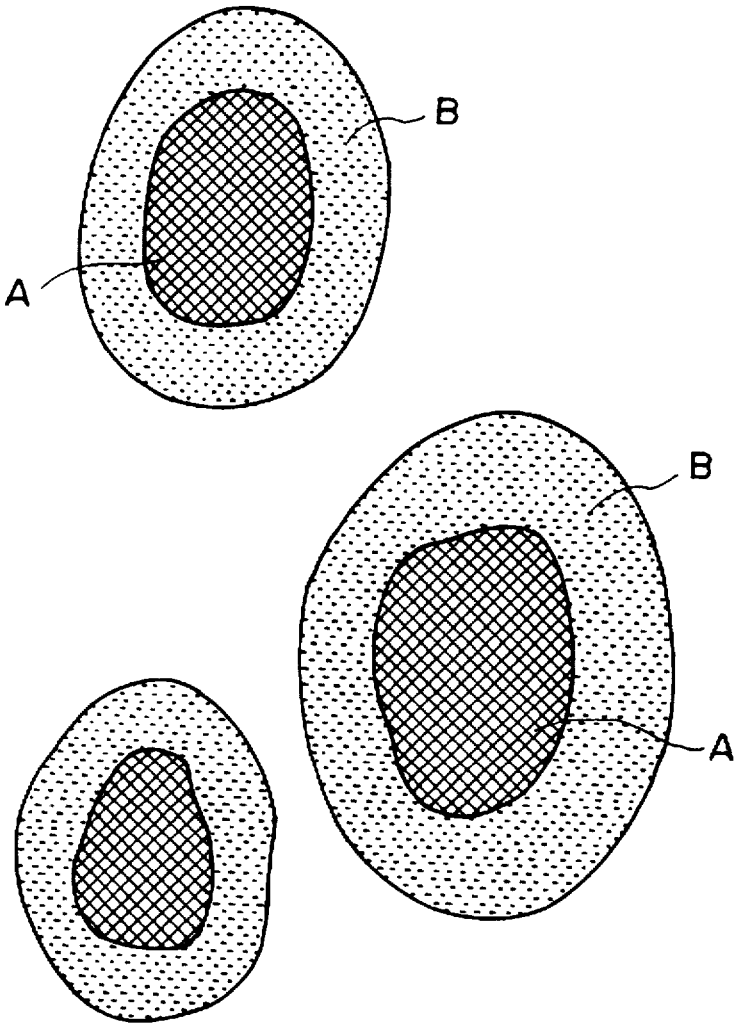
FIGS. 7 and 8 are respectively a schematic sectional illustration of a form of toner particles.
Figure 8:
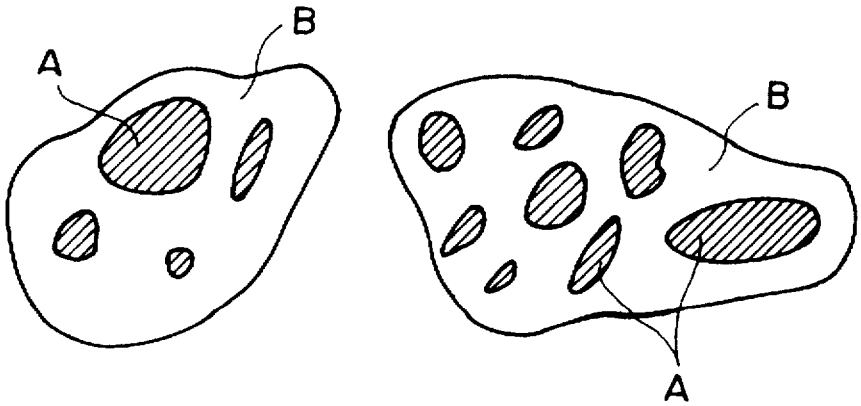

Such a sea-island structure in which the low-softening point substance is enclosed within the binder resin may suitably be provided by dispersing in an aqueous medium a polymerizable monomer composition obtained by mixing a principal monomer, a low-softening point substance having a lower polarity than the principal monomer and a small amount of a resin or monomer having a higher polarity to provide a core-shell structure wherein the low-softening point substance is coated with the resultant binder resin. The resultant polyermizable particles may be used as toner particles as they are or after association of very fine particles up to a desired particle size to provide toner particles having a sea-island structure. In order to produce toner particles of a sea-island dispersion structure according to the above-described process, it is preferred that at least one species of low-softening point substance has a melting point (maximum heat-absorption temperature on a DSC heat absorption curve) which is lower than the polymerization temperature. FIGS. 7 and 8 show schematic illustration of two representative types of sea-island structure of toner particles wherein a low-softening point substance A is enclosed as an island within a sea of shell resin (binder resin) B.

By enclosing the low-softening point substance in toner particles, a relatively large amount of low-softening point substance can be incorporated within toner particles while suppressing the lowering in anti-blocking performance. Further, by using a sharp-melting low-softening point substance, it is possible to provide toner particles having a high mechanical impact strength and yet capable of showing a low-temperature fixability and good color mixing performance at the time of heat-pressure fixation.

The polymerizable monomer suitably used for producing toner particles according to the polymerization process may suitably be a vinyl-type polymerizable monomer capable of radical polymerization. The vinyl-type polymerizable monomer may be a monofunctional monomer or a polyfunctional monomer. Examples of the monofunctional monomer may include: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers, such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylic monomers, such as methyl methacrylate, ethyl methacrylate, n-propyl methacrylate, iso-propyl methacrylate, n-butylmethacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate; methylene aliphatic monocarboxylic acid esters; vinyl esters, such as vinyl acetate, vinyl propionate, vinyl benzoate, vinyl lactate, and vinyl formate; vinyl ethers, such as vinyl methyl ether, vinyl ethyl ether, and vinyl isobutyl ether; and vinyl ketones, such as vinyl methyl ketone, vinyl hexyl ketone, and vinyl isopropyl ketone.

Examples of the polyfunctional monomer may include: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-acryloxydiethoxy)phenyl] propane, trimethylpropane triacrylate, tetramethylmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxydiethoxy)phenyl]propane, 2,2'-bis[4-(methacryloxypolyethoxy)phenyl]propane, trimethylpropane trimethacrylate, tetramethylmethane tetramethacrylate, divinylbenzene, divinylnaphthalene, and divinyl ether.

In the present invention, the above-mentioned monofunctional monomer may be used singly or in combination of two or more species thereof, or optionally in combination with one or more species of the polyfunctional polymerizable monomer. The polyfunctional polymerizable monomer may also be used as a crosslinking agent.

The polymerization initiator used for polymerization of the above-mentioned polymerizable monomer may be an oil-soluble initiator and/or a water-soluble initiator. Examples of the oil-soluble initiator may include: azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators, such as acetylcyclohexylsulfonyl peroxide, diisopropyl peroxycarbonate, decanoyl peroxide, lauroyl peroxide, stearoyl peroxide, propionyl peroxide, acetyl peroxide, t-butyl peroxy-2-ethylhexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, and cumeme hydroperoxide.

Examples of the water-soluble initiator may include: ammonium persulfate, potassium persulfate, 2,2'-azobis(N,N'-dimethyleneisobutyroamidine) hydrochloric acid salt, 2,2'-azobis(2-amidinopropane) hydrochloric acid salt, azobis(isobutylamidine) hydrochloric acid salt, sodium 2,2'-azobisisobutyronitrilesulfonate, ferrous sulfate and hydrogen peroxide.

In the present invention, it is possible to further add a chain transfer agent, a polymerization inhibitor, etc., in order to control the degree of polymerization of the polymerizable monomer.

The toner according to the present invention may particularly preferably be produced through the suspension polymerization process by which a particulate toner having a small particle size of 3–8 μm can be easily produced with a uniformly controlled shape and a sharp particle size distribution. It is also possible to suitably apply the seed polymerization process wherein once-obtained polymerizate particles are caused to adsorb a monomer, which is further polymerized in the presence of a polymerization initiator. It is also possible to include a polar compound in the monomer adsorbed by dispersion or dissolution.

In case where the toner according to the present invention is produced through the suspension polymerization, toner particles may be produced directly in the following manner. Into a polymerizable monomer, a low-softening point substance such as wax, a colorant, a polymerization initiator, a crosslinking agent and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C., preferably 55°–85° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–2.0 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner according to the present invention may preferably have a shape factor SF-1 of 100–160, more preferably 100–150, further preferably 100–125.

The shape factor SF-1 referred to herein is based on values measured in the following manner. Images of 100 toner particles observed through a field emission scanning electron microscope (FE-SEM) ("S-800", available from Hitachi Seisakusho K.K.) at a magnification of, e.g., 500 are sampled at random, and the image data of the toner images are inputted for analysis into an image analyzer (e.g., "Luzex III", available from Nireco K.K.) through an interface, whereby the shape factor SF-1 is calculated by the following equation:

$$SF\text{-}1=[(MXLNG)^2/\text{AREA}]\times(\pi/4)\times 100,$$

wherein MXLNG denotes the maximum diameter of a toner particle and AREA denotes the projection area of the toner particles. The shape factor SF-1 referred to herein is defined as a number-average value of SF-1 values calculated in the above-described manner for the 100 toner particles selected at random. The shape factor SF-1 represents a degree of roundness, and a shape factor SF-1 closer to 100 means that the shape of a toner particle is closer to a true sphere.

In case where the shape factor SF-1 is larger than 160, the toner particles are substantially deviated from spheres but approach indefinite or irregularly shaped particles and correspondingly show a lowering in transfer efficiency (or transfer ratio).

To the toner according to the present invention, it is preferred to add an external additive, examples of which may include: lubricant powder, such as teflon powder, zinc stearate powder, and polyvinylidene fluoride powder; abrasives, such as cerium oxide, silicon carbide, strontium silicate, calcium titanate, and strontium titanate; flowability improvers, such as silica, titanium oxide and aluminum oxide; anti-caking agents; and electroconductivity-imparting agents, such as carbon black, zinc oxide, and tin oxide.

It is particularly preferred to use inorganic fine powder, such as fine powder of silica, titanium oxide, aluminum oxide, strontium silicate, calcium titanate, and strontium titanate. It is preferred that such inorganic fine powder is hydrophobized with a hydrophobizing agent, such as a silane coupling agent, silicone oil or a combination of these.

Such an external additive may suitably be added generally in a proportion of 0.1–5 wt. parts per 100 wt. parts of toner particles.

The toner according to the present invention may preferably show an agglomeratability of 1–30%, more preferably 4–20%, in view of the developing performance.

In the present invention, it is possible to produce a non-magnetic cyan toner, a non-magnetic yellow toner, a non-magnetic magenta toner and a non-magnetic black toner respectively satisfying the above-mentioned properties by using various non-magnetic colorants of respective colors, and use the resultant respective color toners in image forming apparatus for multi-color image formation or full-color image formation. In this instance, as the respective color toners have a characteristic of less deteriorating while enduring pressure and abrasion force applied thereto, they can be suitably used in a non-magnetic mono-component developing device. The non-magnetic monocomponent developing device can be designed in a compact size compared with a two-component developing device and therefore can provide a smaller size of image forming apparatus. Further, as the toner according to the present invention is excellent in low-temperature fixability and anti-offset characteristic, it is also effective in providing a simpler and a smaller-size fixing device in the image forming apparatus.

A specific example of image forming apparatus capable of using respective color toners according to the present invention will now be described with reference to FIG. 5.

Figure 5:
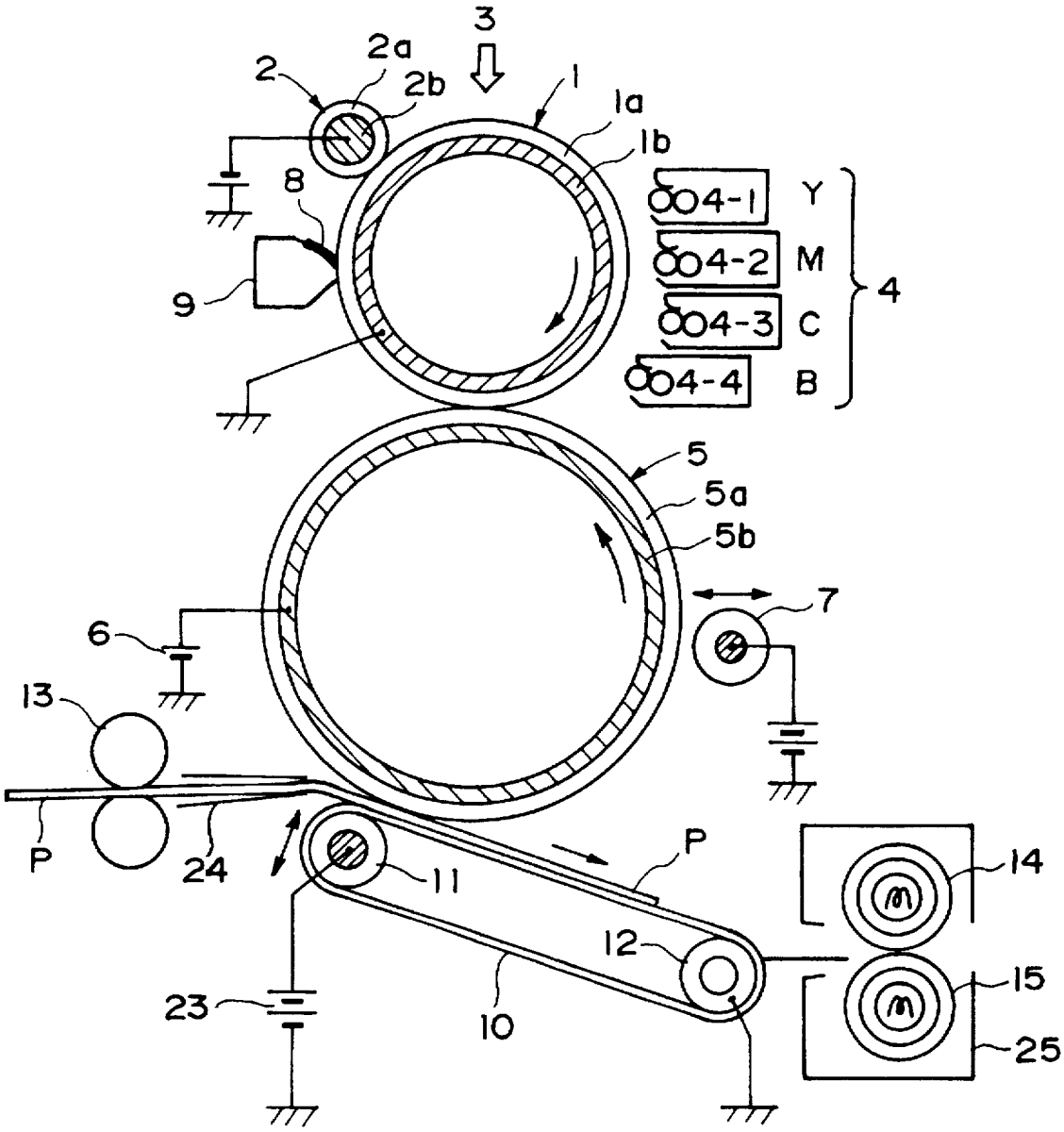
FIG. 5 is an illustration of an image forming apparatus for practicing an image forming method according to the invention.

FIG. 5 is a schematic sectional view of an image forming apparatus (copying machine or laser printer) capable of forming a mono-color image, a multi-color image and a full-color image based on an electrophotographic process. The apparatus includes an elastic roller 5 of a medium resistivity as an intermediate transfer member and a transfer belt 10 as a secondary transfer means.

The apparatus further includes a rotating drum-type electrophotographic photosensitive member (hereinafter called "photosensitive member" or "photosensitive drum") 1 as an image-bearing member, which rotates at a prescribed peripheral speed (process speed) in a clockwise direction as indicated by an arrow. The photosensitive member 1 comprises a support 1*a* and a photosensitive layer 1*b* thereon comprising a photoconductive insulating substance, such as a-Se, CdS, $ZnO_2$, OPC (organic photoconductor), and a-Si (amorphous silicon). The photosensitive member 1 may preferably comprise an a-Si photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

In the present invention, a charging step may be performed by using a corona charger which is not in contact with the photosensitive member 1 or by using a contact charger, such as a charging roller. The contact charging as shown in FIG. 5 may preferably be used in view of efficiency of uniform charging, simplicity and a lower ozone-generating characteristic.

The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated mating with the rotation of the photosensitive member 1.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

In the course of rotation, the photosensitive member 1 is uniformly charged to prescribed polarity and potential by the primary charging roller 2 and then exposed to image light 3 from an unshown imagewise exposure means (e.g., a system for color separation of a color original image and focusing exposure, or a scanning exposure system including a laser scanner for outputting a laser beam modified corresponding to time-serial electrical digital image signals based on image data) to form an electrostatic latent image corresponding to a first color component image (e.g., yellow image) of the objective color image.

Then, the electrostatic latent image is developed with a yellow toner (as a first color toner) in a first developing device 4-1. The developing device 4-1 constitutes an apparatus unit which is detachably mountable to a main assembly of the image forming apparatus, and an enlarged view thereof is shown in FIG. 6.

Figure 6:
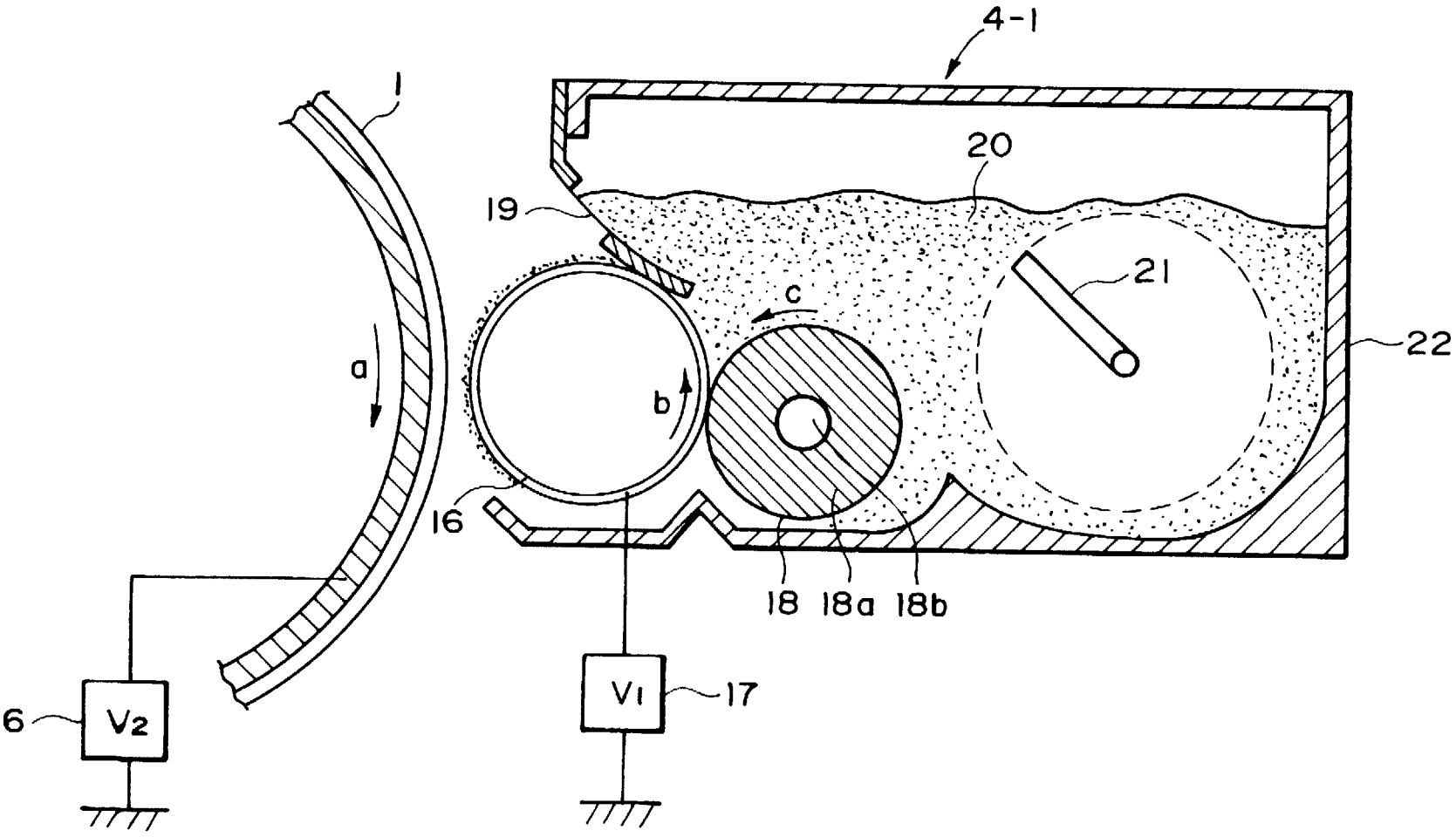
FIG. 6 is a schematic illustration of an embodiment of the apparatus unit according to the invention.

Referring to FIG. 6, the developing device 4-1 includes an outer wall or casing 22 enclosing a mono-component non-magnetic yellow toner 20. Being half enclosed within the outer wall 22, a developing sleeve 16 (as a toner-carrying member) is disposed opposite to the photosensitive member 1 rotating in an indicated arrow a direction and so as to develop the electrostatic image on the photosensitive member 1 with the toner carried thereon, thereby forming a toner image on the photosensitive member 1. As shown in FIG. 6, a right half of the developing sleeve 16 is protruded and enclosed in the outer wall 22 and a left half thereof is exposed out of the outer wall 22 and disposed in a lateral position with the photosensitive member 1 and so as to be movable in an indicated arrow b direction while facing the photosensitive member 1. A small gap is left between the developing sleeve 16 and the photosensitive member 1.

The toner-carrying member need not be in a cylindrical form like the developing sleeve 16, but can be in an endless belt form driven in rotation or composed of an electroconductive rubber roller.

In the outer wall 22, an elastic blade 19 (as an elastic regulation member) is disposed above the developing sleeve 16, and a toner application roller 18 is disposed upstream of the elastic blade 19 in the rotation direction of the developing sleeve 16. The elastic regulation member can also be an elastic roller.

The elastic blade 19 is disposed with a downward inclination toward the upstream side of the rotation direction of the developing sleeve, and abutted counterdirectionally against an upper rotating peripheral surface of the developing sleeve.

The toner application roller 18 is abutted rotatably against a side of the developing sleeve 16 opposite to the photosensitive member 1.

In the developing device 4-1 having the above-described structure, the toner application roller 18 is rotated in an arrow c direction to supply the yellow toner 20 to the vicinity of the developing sleeve 16 and, at an abutting position (nip position) with the developing sleeve 16, frictionally applies or attaches the yellow toner 20 onto the developing sleeve 16.

Along with the rotation of the developing sleeve 16, the yellow toner 20 attached to the developing sleeve 16 is caused to pass between the elastic blade 19 and the developing sleeve 16 at their abutting position, where the toner is rubbed with the surfaces of both the developing sleeve 16 and the elastic blade 19 to be provided with a sufficient triboelectric charge.

The thus triboelectrically charged yellow toner 20 having passed through the abutting position between the developing sleeve 16 and the elastic blade 19 forms a thin layer of yellow toner to be conveyed to a developing position facing the photosensitive member 1. At the developing position, the developing sleeve 16 is supplied with a DC-superposed AC bias voltage by a bias application means 17, whereby the yellow toner 20 on the developing sleeve is transferred and attached onto the electrostatic image on the photosensitive member 1, to form a toner image.

A portion of the yellow toner 20 remaining on the developing sleeve 16 without being transferred onto the photosensitive member 1 at the developing position is recovered into the outer wall 22 while passing below the developing sleeve 16 along with the rotation of the developing sleeve 16.

The recovered yellow toner 20 is peeled apart from the developing sleeve 16 by the toner application roller 18 at the abutting position with the developing sleeve 16. Simultaneously therewith, a fresh yellow toner 20 is supplied to the developing sleeve 16 by the rotation of the toner application roller 18, and the fresh yellow toner 20 is again moved to the abutting position between the developing sleeve and the elastic blade 19.

On the other hand, most of the yellow toner 20 peeled apart from the developing sleeve 16 is mixed with the remaining toner 22 in the outer wall, whereby the triboelectric charge of the peeled-apart toner is dispersed therein. A portion of the toner at a position remote from the toner application roller 18 is gradually supplied to the toner application roller 18 by a stirring means 21.

The toner according to the present invention exhibits good developing performance and continuous image forming characteristic in the above-described non-magnetic mono-component developing step.

The developing sleeve 16 may preferably comprise an electroconductive cylinder of a metal or alloy, such as aluminum or stainless steel, but can be composed of an electroconductive cylinder formed of a resin composition having sufficient mechanical strength and electroconductivity. The developing sleeve 16 may comprise a cylinder of a metal or alloy surface-coated with a coating layer of a resin composition containing electroconductive fine particles dispersed therein.

The electroconductive particles may preferably exhibit a volume resistivity of at most 0.5 ohm.cm after compression at 120 kg/cm$^2$. The electroconductive fine particles may preferably comprise carbon fine particles, a mixture of carbon fine particles and crystalline graphite powder, or crystalline graphite powder. The electroconductive fine particles may preferably have a particle size of 0.005–10 μm.

Example of the resin material constituting the resin composition may include: thermoplastic resins, such as styrene resin, vinyl resin, polyethersulfone resin, polycarbonate resin, polyphenylene oxide resin, polyamide resin, fluorine-containing resin, cellulosic resin, and acrylic resin; and thermosetting or photocurable resins, such as epoxy resin, polyester resin, alkyd resin, phenolic resin, melamine resin, polyurethane resin, urea resin, silicone resin, and polyimide resin.

Among the above, it is preferred to use a resin showing a releasability such as silicone resin or fluorine-containing resin; or a resin showing excellent mechanical properties, such as polyethersulfone, polycarbonate, polyphenylene oxide, polyamide, phenolic resin, polyester, polyurethane or styrene resin. Phenolic resin is particularly preferred.

The electroconductive fine particles may preferably be used in 3–20 wt. parts per 100 wt. parts of the resin component.

In the case of using a mixture of carbon fine particles and graphite particles, it is preferred to use 1–50 wt. parts of carbon fine particles per 100 wt. parts of graphite particles.

The electroconductive particle-dispersed resin coating layer of the sleeve may preferably show a volume resistivity of $10^{-6}$–$10^{6}$ ohm.cm.

The image forming apparatus shown in FIG. 5 further includes a magenta developing device 4-2, a cyan developing device 4-3 and a black developing device 4-4, each of which may be a non-magnetic mono-component developing device having a structure similar to that of the yellow developing device 4-1 described above with reference to FIG. 6.

However, only the black developing device 4-4 can be of a magnetic monocomponent type using an insulating magnetic toner as desired.

The intermediate transfer member 5 is driven in rotation at an identical peripheral speed as the photosensitive drum 1 in an indicated arrow direction.

The yellow toner image (as a first color toner image) formed on the photosensitive drum 1 is intermediately transferred onto an outer peripheral surface of the intermediate transfer member 5 in the course of passing through a nip position between the photosensitive drum 1 and the intermediate transfer member 5 under the action of a pressure and an electric field formed by a primary transfer bias voltage (e.g., a positive voltage opposite to the polarity of the toner charge) supplied from a bias supply means 6 to the intermediate transfer member 5. The intermediate transfer member can be in the form of an endless belt instead of the drum 5 as shown.

Thereafter, a magenta toner image (second color toner image), a cyan toner image (third color toner image) and a black toner image (fourth color toner image) are similarly and successively transferred in superposition onto the intermediate transfer member 5 to form thereon a synthetic color toner image corresponding to the objective colorimage.

The transfer belt 10 (as a secondary transfer means) is wound about a bias roller 11 and a tension roller 12 having shafts extending in parallel with the rotation axis of the intermediate transfer member 5 so as to contact a lower peripheral surface of the transfer member 5. The bias roller 11 is supplied with a prescribed secondary transfer bias voltage from a bias supply 23, and the tension roller 12 is grounded.

During the successive transfer of the first to fourth color toner images from the photosensitive drum 1 to the intermediate transfer member 5, the transfer belt 10 and an intermediate transfer member cleaning roller 7 may be separated from the intermediate transfer member 5.

The synthetic color toner image superposedly transferred onto the intermediate transfer member 5 may be transferred onto a transfer material P by abutting the transfer belt 10 against the intermediate transfer member 5, supplying the transfer material P from a paper supply cassette (not shown) via resist rollers 13 and a transfer pre-guide 24 to a nip position between the intermediate transfer member 5 and the transfer belt 10 at a prescribed timing, and simultaneously applying a secondary transfer bias (voltage) from the bias supply 23 to the bias roller 11. Under the action of the secondary transfer bias, the synthetic color toner image is transferred from the intermediate transfer member 5 to the transfer material P. This step is called a secondary transfer (step) herein. The secondary transfer may also be performed by using a transfer roller supplied with a transfer bias instead of the transfer belt described above.

The transfer material P carrying the toner image transferred thereto is introduced into a heat-pressure fixing device 25 comprising a heating roller 14 and a pressing roller 15 where the toner image is fixed onto the transfer material P. The toner according to the present invention can be well fixed without applying an offset-preventing agent, such as silicone oil, onto the heating roller.

The intermediate transfer member 5 comprises a pipe-like electroconductive core metal **5*b* and a medium resistance-elastic layer 5*a* (e.g., an elastic roller) surrounding a periphery of the core metal 5*b*. The core metal 5*b* can comprise a plastic pipe coated by electroconductive plating. The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 5 is disposed under the photosensitive member 1 so that it has an axis (or a shaft) disposed in parallel with that of the photosensitive member 1 and is in contact with the photosensitive member 1. The intermediate transfer member 5 is rotated in the direction of an arrow (counterclockwise direction) at a peripheral speed identical to that of the photosensitive member 1**.

After the intermediate transfer of the respective toner image, the surface of the intermediate transfer member 5 is cleaned, as desired, by a cleaning means 10 which can be attached to or detached from the image forming apparatus. In case where the toner image is placed on the intermediate transfer member 5, the cleaning means 10 is detached or released from the surface of the intermediate transfer member 5 so as not to disturb the toner image.

For example, the cleaning of the intermediate transfer member 5 may be performed simultaneously with the primary transfer from the photosensitive drum 1 to the intermediate transfer member 5 by transferring the residual toner on the intermediate transfer member 5 after the secondary transfer back to the photosensitive drum 1 and recovering the re-transferred toner by the cleaner 9 of the photosensitive drum 1. The mechanism is described below.

A toner image formed on the intermediate transfer member 5 is transferred onto a transfer material sent to the transfer belt 10 under the action of a strong electric field caused by a secondary transfer bias of a polarity opposite to the charged polarity (negative) of the toner image applied to the bias roller 11.

At this time, the secondary transfer residual toner remaining on the intermediate transfer member 5 without being transferred to the transfer material P is frequently charged to a polarity (positive) reverse to the normal polarity (negative). However, this doe not mean that all the secondary transfer residual toner is charged to a reverse polarity (positive), but a portion thereof has no charge due to neutralization or retains a negative polarity.

Accordingly, a charging means 7 for charging such a portion of toner having no charge due to neutralization or retaining a negative polarity to a reverse polarity of positive is disposed after the secondary transfer position and before the primary transfer position. As a result, almost all the secondary transfer residual toner can be returned to the photosensitive member 1.

When the reverse-transfer of the secondary transfer residual toner to the photosensitive member 1 and the primary transfer of the toner image formed on the photosensitive member 1 to the intermediate transfer member 5 are performed simultaneously, the secondary transfer residual toner reversely charged on the intermediate transfer member 5 and the normal toner for the primary transfer are not substantially neutralized with each other at the nip position between the photosensitive member 1 and the intermediate transfer member 5, but the reversely charged toner and the normally charged toner are transferred to the photosensitive member 1 and the intermediate transfer member 5, respectively.

This is because the transfer bias voltage is suppressed at a low level so as to cause only a weak electric field at the primary transfer nip between the photosensitive member 1 and the intermediate transfer member 5, thereby preventing the occurrence of discharge at the nip and the polarity inversion of the toner at the nip.

Further, as the triboelectrically charged toner is electrically insulating so that portions thereof charged to opposite polarities do not cause polarity inversion or neutralization in a short time.

Accordingly, the secondary transfer residual toner charged positively on the intermediate transfer member 5 is transferred to the photosensitive member 1, and the negatively charged toner image on the photosensitive member 1 is transferred to the intermediate transfer member 5, thus behaving independently from each other.

In the case of forming an image on one sheet of transfer material P in response to one image formation initiation signal, it is possible that, after the secondary transfer, the toner image transfer from the photosensitive member 1 to the intermediate transfer member is not performed, but only the secondary transfer residual toner remaining on the intermediate transfer member 5 is reversely transferred to the photosensitive member 1.

In a specific embodiment, a cleaning roller 7 comprising an elastic roller having plural layers may be used as a contact charging means for charging the secondary transfer residual toner on the intermediate transfer member 5.

Hereinbelow, some methods for measuring the properties of toners and low-softening point substances referred to herein will be described.

Rheological properties of toners

Measurement is performed by using a visco-elasticity measurement apparatus ("Rheometer RDA-II", available from Rheometrics Co.) with respect to a storage modulus G', a loss modulus G", a temperature (Tc) of intersection between G' and G", and tan (δ) in a temperature range of 30°–200° C.

Shearing means: Parallel plates having diameters of 7.9 mm for a high-modulus sample or 25 mm for a low-modulus sample.

Measurement sample: A toner is heat-melted and then molded into a cylindrical sample having a diameter of ca. 8 mm and a height of 1.5–5 mm or a disk sample having a diameter of ca. 25 mm and a thickness of 1.5–3 mm.

Measurement frequency: 6.28 radian/sec.

Setting of measurement strain: Initial value is set to 0.1%, and the measurement is performed according to an automatic measurement mode.

Correction for sample elongation: Performed by an automatic measurement mode.

Measurement temperature: Increased at a rate of 2° C./min, from 25° C. to 250° C.

DSC heat-absorption peaks (melting points) of low-softening point substance

Measurement is performed by using a differential scanning calorimeter ("DSC-7", available from Perkin-Elmer Corp.) according to ASTM D-3418-82. A sample in an amount of 2–10 mg, preferably ca. 5 mg, is accurately weighed. The sample is placed on an aluminum pan and subjected to measurement in a temperature range of 30°–200° C. at a temperature-raising rate of 10° C./min in a normal temperature/normal humidity environment. A heat-absorption main peak temperature ($T_{m.p.}$) and a half-value width (a temperature width at a half of the heat-absorption main peak, denoted by $W_{1/2}$) are recorded.

Gloss of fixed toner images

Gloss is measured by using a handy gloss meter ("Gloss Meter PG-3D", available from Nippon Denshoku Kogyo K.K.) at a light incident angle of 75 deg.

Cross-section of toner particles

Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the low-softening point compound and the outer resin by utilizing a difference in crystallinity therebetween.

Agglomeratability (Dag) of toner

The flowability of a toner may be evaluated by an agglomeratability of the toner measured in the following manner.

The agglomeratability of a sample toner is measured by using a powder tester (available from Hosokawa Micron K.K.). On a vibration table, a 400 mesh-sieve, a 200 mesh-sieve and a 100 mesh-sieve are set in superposition in this order, i.e., so that the 100-mesh sieve having the largest opening is placed at the uppermost position. On the set sieves, 5 g of a sample toner is placed, and the sieves are vibrated for 25 sec at an input voltage to the vibration table of 15 volts. Then, the weights of the toner remaining on the respective sieves are measured to calculate the agglomeratability according to the following formula:

$$\text{Agglomeratability (\%)}=(a/5+(b/5)\times 0.6+(c/5)\times 0.2)\times 100,$$

wherein a: weight of toner on 100 mesh-sieve (g)

b: weight of toner on 200 mesh-sieve (g)

c: weight of toner on 400 mesh-sieve (g).

A lower agglomeratability represents a higher flowability of toner.

Toner particle size distribution

Coulter Counter TA-II or Coulter Multisizer II (available from Coulter Electronics Inc.) is used together with an electrolytic solution comprising a ca. 1% NaCl aqueous solution which may be prepared by dissolving a reagent-grade sodium chloride or commercially available as "ISOTON-II" (from Counter Scientific Japan).

For measurement, into 100 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 μm-aperture. The volume and number of toner particles are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

Acid value (AV) (JIS-acid value)

1) Ca. 0.1–0.2 g of a sample is accurately weighed to record its weight at W (g).

2) The sample is placed in an Erlenmeyer flask and 100 cc of a toluene/ethanol (2/1) mixture solution is added thereto to dissolve the sample.

3) Several drops of phenolphthalein alcohol solution is added as an indicator.

4) The solution in the flask is titrated with a 0.1N—KOH alcohol solution from a buret.

The amount of the KOH solution used for the titration is denoted by S (ml). A blank test is performed in parallel to determine the amount of the KOH solution for the blank titration at B (ml).

5) The acid value of the sample is calculated by the following formula:

$$\text{Acid value}=(S-B)\times f\times 5.61/W,$$

wherein f denotes a factor of the KOH solution.

Anti-blocking property

Ca. 10 g of a sample toner is placed in a 100 cc-plastic cup and left standing for 3 days at 50° C. The state of the toner is then observed with eyes and evaluated according to the following standard.

A: No agglomerate observed.

B: Agglomerate is observed but readily collapsed.

C: Agglomerate is observed but collapsed by shaking.

D: Agglomerate can be grasped by fingers and cannot be collapsed readily.

Hereinbelow, the present invention will be described more specifically based on Examples.

EXAMPLE 1

| | |
|---|---|
| Styrene monomer | 165 wt. parts |
| n-Butyl acrylate monomer | 35 wt. parts |
| Phthalocyanine pigment (C.I. Pigment Blue 15:3) | 14 wt. parts |
| Linear polyester resin (polycondensation between polyoxypropylene-adducted bisphenol A and phthalic acid; AV (acid value) = 8 mgKOH/g) | 10 wt. parts |
| Dialkyl salicylic acid aluminum compound | 2 wt. parts |
| Divinylbenzene | 0.5 wt. parts |
| Ester wax (ester between $C_{22}$-alkyl carboxylic acid and $C_{22}$-alkyl alcohol ($T_{mp}$ (DSC main peak) = 75° C., $W_{1/2}$ (half-value width) = 3° C.) | 30 wt. parts |

The above ingredients were subjected to dispersion for 3 hours by an attritor, and then 3 wt. parts of lauroyl peroxide (polymerization initiator) was added thereto to formulate a polymerizable monomer composition, which was then charged into an aqueous medium at 70° C. comprising 1200 wt. parts of water and 7 wt. parts of tricalcium phosphate and subjected to formation of particles under stirring for 10 min. by a TK-type homomixer at 10,000 rpm. Then, the homomixer was replaced by a propeller stirring blade, which was stirred at 60 rpm for 10 hours of polymerization. After completion of the polymerization, dilute hydrochloric acid was added to the system to remove the calcium phosphate. Then, the polymerizate was washed and dried to obtain cyan toner particles having a weight-average particle size ($D_4$)= 6.5 μm. As a result of microscopic observation of section, the resultant cyan toner particles showed a structure as shown in FIG. 7 wherein the low-softening point substance (A) was coated with the outer shell (B).

100 wt. parts of the above-prepared cyan toner particles and 1.5 wt. parts of hydrophobic silica fine powder were blended by a Henschel mixer to obtain Cyan Toner 1.

Cyan Toner 1 showed temperature-dependent viscoelastic properties including storage modulus G', loss modulus G" and tan (δ) as shown in FIG. 1.

Cyan Toner 1 showed SF-1=105, comprised ca. 12 wt. parts (ca. 12 wt. % of the toner) of ester wax per 100 wt.

parts of binder resin comprising styrene/n-butyl acrylate copolymer crosslinked with divinylbenzene and linear polyester resin, and had a THF-insoluble content (THF ins.) of ca. 10 wt. % (based on the binder).

The properties of Cyan Toner 1 are shown in Table 1.

Comparative Example 1

Cyan Toner 2 was prepared in the same manner as in Example 1 except that the ester wax was replaced by paraffin wax (Tmp=63° C., $W_{1/2}$=40° C.) and the divinylbenzene was omitted.

Figure 2:
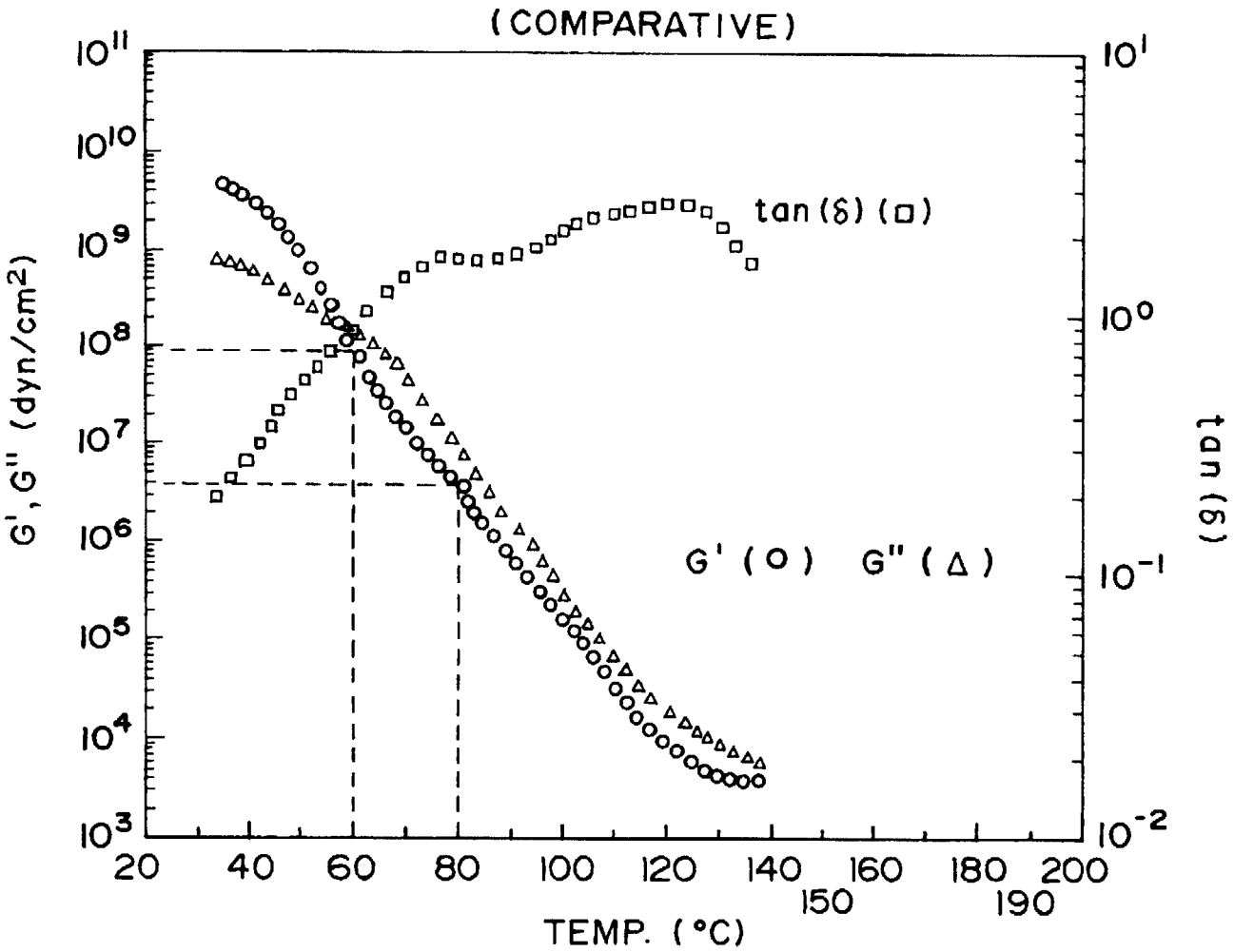
FIGS. 2 and 3 are respectively a graph showing a storage modulus curve, a loss modulus curve and a tan (δ) curve of a comparative toner.

Cyan toner 2 showed temperature-dependent viscoelasticities including storage modulus G', loss modulus G" and tan (δ) as shown in FIG. 2.

The binder resin of Cyan Toner 2 was non-crosslinked and had no THF-insoluble content. In the viscoelasticity measurement, Cyan Toner 2 showed a remarkable lowering in viscosity and it was impossible to measure the viscoelasticities G' and G" above 140° C. The properties of Cyan Toner 2 are also shown in Table 1 together with those of Cyan Toner 1 and other toners.

Comparative Example 2

Cyan Toner 3 was prepared in the same manner as in Example 1 except that the ester wax was replaced by paraffin wax (Tmp.=63° C., $W_{1/2}$=40° C.).

Figure 3:
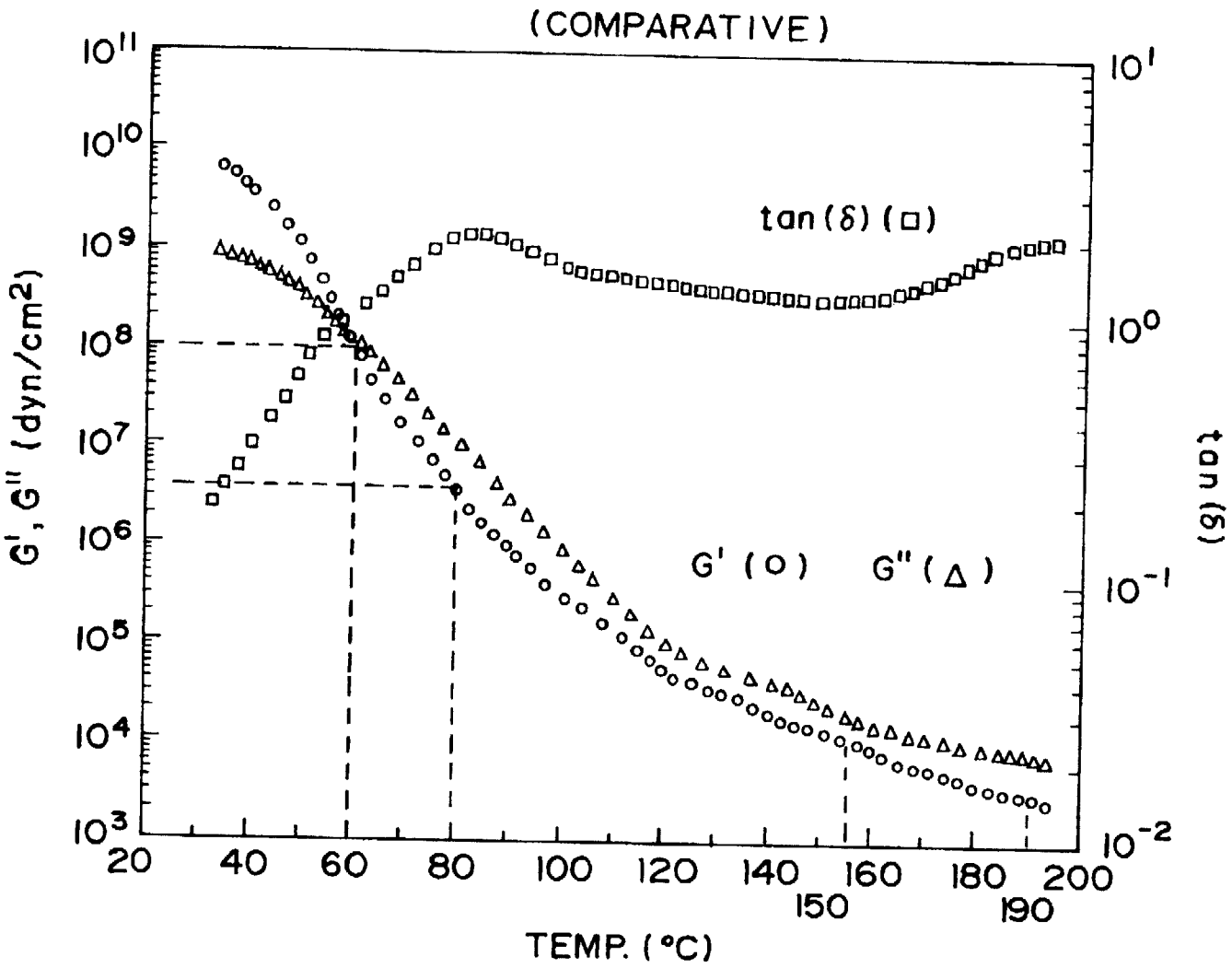
Figure 4:
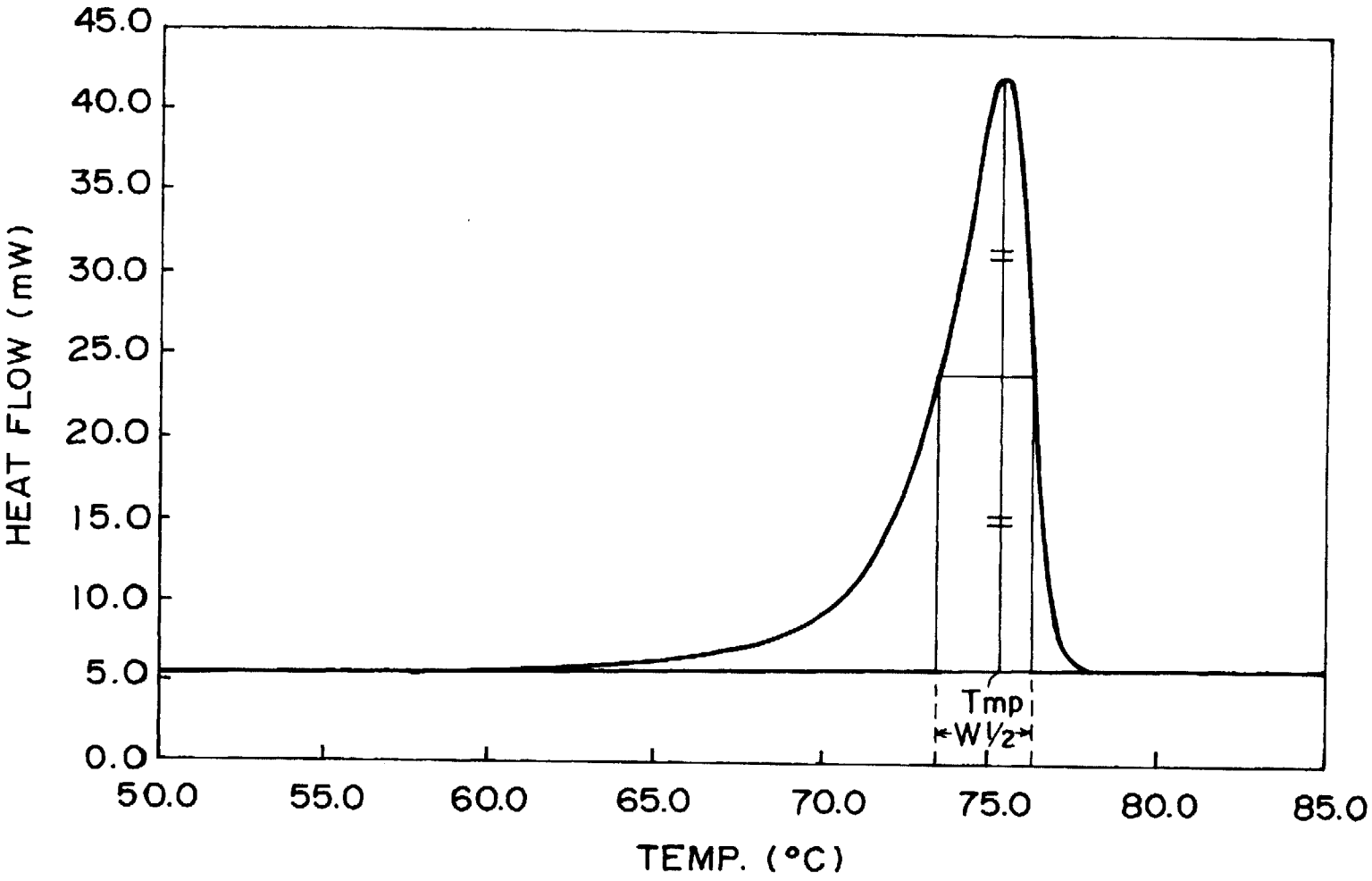
FIG. 4 is a graph showing a DSC heat-absorption curve of a low-softening point substance.

Cyan Toner 3 showed temperature-dependent viscoelasticities including storage modulus G', loss modulus G" and tan (δ) as shown in FIG. 3. Cyan Toner 3 showed a ($G'_{60}/G'_{80}$) ratio of ca. 20, thus showing a smaller change in G' on temperature increase from 60° C. to 80° C.

Comparative Example 3

Cyan Toner 4 was prepared in the same manner as in Example 1 except that the ester wax was replaced by polypropylene wax ("Viscol 660P", mfd. by Sanyo Kasei K.K.; Tmp.=137° C., $W_{1/2}$=7° C.).

Cyan Toner 4 showed a ($G'_{60}/G'_{80}$) ratio of ca. 71.4.

Comparative Example 4

Cyan Toner 5 was prepared in the same manner as in Example 1 except that the amount of the ester wax was changed to 5 wt. parts.

Cyan Toner 5 contained 2.4 wt. parts of the ester wax per 100 wt. parts of the binder resin.

Comparative Example 5

Cyan Toner 6 was prepared in the same manner as in Example 1 except that the amount of the ester wax was changed to 100 wt. parts.

Cyan Toner 6 contained 47 wt. parts of the ester wax per 100 wt. parts of the binder resin.

Comparative Example 6

Cyan Toner 7 was prepared in the same manner as in Example 1 except that the amount of the divinylbenzene was changed to 2 wt. parts.

Cyan Toner 7 had a THF-insoluble content of 47 wt. %.

Comparative Example 7

| | |
|---|---|
| Styrene/n-butyl acrylate/ divinylbenzene copolymer (Mw = $1.63 \times 10^5$, main peak molecular weight (MW peak) = $2.25 \times 10^4$, $THF_{ins}$ = 13.5 wt. %) | 100 wt. parts |
| Linear polyester resin (Same as in Example 1) | 5 wt. parts |
| Dialkylsalicylic acid aluminum compound | 1 wt. part |
| Ester wax (Same as in Example 19 | 3 wt. parts |

The above ingredients were sufficiently blended by a Henschel mixer and melt-kneaded through a twin-screw extruder at ca. 130° C., followed by cooling, coarse crushing by a hammer mill into ca. 1–2 mm, pulverization by an air jet pulverizer and classification to recover cyan toner particles having $D_4$ (weight-average particle size) of 7.5 μm.

100 wt. parts of the cyan toner particles and 1.5 wt. parts of hydrophobic silica fine powder were blended to obtain Cyan Toner 8.

Comparative Example 8

Cyan Toner 9 was prepared in the same manner as in Comparative Example 7 except that the amount of the ester wax was increased to 15 wt. parts.

TABLE 1

| | Cyan toner | $G'_{60}$ (dyn/cm²) | $G'_{80}$ (dyn/cm²) | $G'_{60}/G'_{80}$ | $G'_{155}$ (dyn/cm²) | $G'_{190}$ (dyn/cm²) | $G'_{155}/G'_{190}$ | $G''_{40}$ (dyn/cm²) |
|---|---|---|---|---|---|---|---|---|
| Ex. 1 | 1 | $7.1 \times 10^8$ | $3.5 \times 10^6$ | 203.0 | $1.3 \times 10^4$ | $3.6 \times 10^3$ | 3.6 | $1.1 \times 10^9$ |
| Comp. Ex. | | | | | | | | |
| 1 | 2 | $9.2 \times 10^7$ | $3.9 \times 10^6$ | 23.6 | — | — | — | $6.8 \times 10^8$ |
| 2 | 3 | $8.1 \times 10^7$ | $4.2 \times 10^6$ | 19.3 | $1.6 \times 10^4$ | $2.1 \times 10^3$ | 7.6 | $6.2 \times 10^8$ |
| 3 | 4 | $1.5 \times 10^9$ | $2.1 \times 10^7$ | 71.4 | $6.1 \times 10^4$ | $5.3 \times 10^4$ | 1.1 | $1.2 \times 10^9$ |
| 4 | 5 | $6.3 \times 10^9$ | $9.4 \times 10^6$ | 67.0 | $3.5 \times 10^4$ | $5.7 \times 10^3$ | 6.1 | $1.0 \times 10^9$ |
| 5 | 6 | $2.1 \times 10^8$ | $2.9 \times 10^6$ | 72.4 | $5.5 \times 10^3$ | $8.7 \times 10^2$ | 6.3 | $7.3 \times 10^8$ |
| 6 | 7 | $7.7 \times 10^8$ | $1.3 \times 10^7$ | 59.2 | $5.4 \times 10^4$ | $3.8 \times 10^4$ | 1.4 | $1.2 \times 10^9$ |
| 7 | 8 | $2.5 \times 10^8$ | $3.8 \times 10^6$ | 65.8 | $8.4 \times 10^3$ | $9.1 \times 10^2$ | 9.2 | $8.1 \times 10^8$ |
| 8 | 9 | $8.5 \times 10^8$ | $1.2 \times 10^7$ | 70.8 | $9.8 \times 10^3$ | $1.9 \times 10^3$ | 5.2 | $9.1 \times 10^8$ |

TABLE 1-continued

| | $G''_{max}$ (dyn/cm$^2$)/°C. | tan (δ) max/°C. | $D_4$ (μm) | SF-1 | $THF_{ins}$ (wt. %) | Binder resin GPC peak or shoulder molecular weight** (×10$^4$) Main peak | Sub-peak or shoulder ≧ $10^5$ | Dag* (%) | Anti-block |
|---|---|---|---|---|---|---|---|---|---|
| Ex. 1 | 1.8 × 10$^9$/50.5 | 3.2/69 | 6.5 | 105 | 9.6 | 2.2 | 15 (S), 110 (S) | 4.8 | A |
| Comp. Ex. | | | | | | | | | |
| 1 | — | 1.6/78 | 6.5 | 104 | 0 | 1.8 | — | 65.0 | D |
| 2 | — | 2.1/82 | 6.5 | 104 | 9.6 | 2.25 | 14 (S), 100 (S) | 40.0 | D |
| 3 | 2.3 × 10$^9$/67 | 2.9/76 | 7.8 | 131 | 9.3 | 2.1 | 16 (S), 120 (S) | 28.0 | C |
| 4 | 2.0 × 10$^9$/66 | 2.9/73 | 6.4 | 105 | 10.4 | 2.3 | 15 (S), 115 (S) | 4.3 | A |
| 5 | — | 1.8/63 | 8.2 | 132 | 8.5 | 1.9 | 13 (S), 110 (S) | 35.0 | C |
| 6 | 2.0 × 10$^9$/53 | 2.0/75 | 6.6 | 105 | 47.0 | 3.2 | 25 (S) | 5.3 | A |
| 7 | — | 1.7/63 | 7.5 | 165 | 0 | 2.1 | 75 (S) | 54.0 | C |
| 8 | 9.8 × 10$^8$/49 | 2.1/68 | 7.4 | 163 | 0 | 2.1 | 74 (S) | 38.0 | C |

*: Dag = agglomeratability
**: (S) means the molecular weight of a shoulder.

EXAMPLE 2

Cyan Toner 1 was charged in a developing device 4-3 (apparatus unit), incorporated in an image forming apparatus shown in FIG. 5 and subjected to an image formation test according to a mono-color mode. During a continuous image formation on 5000 sheets, good cyan-colored fixed images were formed at a high density and without fog. After the 5000 sheets of the continuous image formation test, the toner application roller 18, the developing sleeve 16 and the elastic blade 19 were free from toner melt-sticking, thus showing a good continuous image forming characteristic. Further, oilless fixation was performed without applying dimethylsilicone oil onto the heating roller 14, no offset was observed. Further, the fixing temperature was varied in the range of 160°–190° C., whereby little change in gloss value was observed. The results are inclusively shown in Table 2 together with those of Examples appearing hereinafter.

Comparative Examples 9–16

Image forming tests were formed in the same manner as in Example 2 except for using Cyan Toners 2–9 instead of Cyan Toner 1.

Image density (I.D.)

The image density of a solid image portion (a portion showing a gloss in the range of 25–35 as measured by a gloss meter ("PG-3D", available from Nippon Denshoku Kogyo K.K.)) is measured by using a Macbeth reflection densitometer (available from Macbeth Co.).

Fog

Based on reflectance values measured by using a reflectance meter ("REFLECTOMETER MODEL TC-6DS", available from Tokyo Denshoku K.K.) while using an amber filter in case of cyan toner images, fogs are calculated according to the following equation. A smaller value means a lower degree of fog.

Fog (reflectance) (%)=[reflectance of standard paper (%)]−[reflectance of non-image portion of a sample (%)]

Fixing initiation temperature ($T_{FI}$ and Higher offset-free temperature ($T_{H.OFF}$)

A heat-pressure fixing device including a fluorine resin-surfaced heating roller 14 and a pressure roller 15 is used for fixation while varying the temperatures of the heating roller and the pressure roller at a temperature-controlled increment of 5° C. The fixed images at the respective fixing temperatures are rubbed two times (one reciprocation) with a lens-cleaning paper under a load of 50 g/cm$^2$, and a lowest fixing temperature giving an image density lowering of 10% or less after the rubbing is taken as a fixing initiation temperature ($T_{FI}$ (°C.)).

The fixing temperature is successively raised at an increment of 5° C., and a maximum temperature at which the fixing is performed without causing offset according to observation with eyes is taken as a higher offset-free temperature ($T_{H.OFF}$ (°C.)).

Evaluation of developing device during or after continuous image forming test

If an image defect attributable to a developing device is found in a resultant image, the image formation is terminated, and the toner application roller surface, the developing sleeve surface and the elastic blade surface are observed with eyes with respect to soiling and melt-sticking of toner.

In case where no such image defects are observed during the continuous image forming test, the application roller surface, the developing sleeve surface and the elastic blade surface are observed with eyes with respect to soiling and melt-sticking of toner after the continuous image forming test. The results are evaluated according to the following standard.

A: Substantially no soiling or toner melt-sticking.

B: Soiling or toner melt-sticking is observed but noticeable image defects do not occur.

C: Conspicuous soiling or toner melt-sticking occurs and image defects occur.

TABLE 2

| | Cyan toner | Image density Initial | Image density After 5000 sheets | Fog Initial | Fog After 5000 sheets | $T_{FI}$* (°C.) | $T_{H.OFF}$* (°C.) | Gloss of final image at 160° C. | Gloss of final image at 190° C. | Soiling within developing drive: Toner appln. roller | Developing sleeve | Elastic blade |
|---|---|---|---|---|---|---|---|---|---|---|---|---|
| Ex. 2 | 1 | 1.50 | 1.55 | 0.5 | 0.7 | 140 | 210 | 11 | 18 | A | A | A |
| Comp. Ex. | | | | | | | | | | | | |
| 9 | 2 | 1.25 | 0.91 | 3.2 | 5.8 | 140 | 180 | 15 | — | C | C | C |
| 10 | 3 | 1.30 | 0.98 | 2.7 | 5.3 | 150 | 210 | 11 | 25 | C | C | C |
| 11 | 4 | 1.45 | 1.35 | 0.8 | 2.8 | 180 | 210 | — | 15 | A | B | B |
| 12 | 5 | 1.51 | 1.53 | 0.5 | 0.6 | 160 | 180 | 8 | — | A | A | A |
| 13 | 6 | 1.38 | 1.15 | 1.8 | 4.8 | 140 | 220 | 12 | 35 | B | C | C |
| 14 | 7 | 1.56 | 1.50 | 0.6 | 0.9 | 190 | 220 | — | 8 | A | A | A |
| 15 | 8 | 1.28 | 0.97 | 3.0 | 5.6 | 140 | 200 | 10 | 40 | B | C | C |
| 16 | 9 | 1.34 | 1.20 | 2.5 | 4.6 | 160 | 190 | 5 | 38 | B | C | B |

*$T_{FI}$: Fixing initiation temperature (°C.)
$T_{H.OFF}$: Higher offset free temperature (°C.)

EXAMPLE 3

Yellow Toner 1 was prepared in the same manner as in Example 1 except that a yellow colorant (C.I. Pigment Yellow 173) was used instead of the phthalocyanine pigment. The properties thereof are shown in Table 3.

Comparative Examples 17–24

Yellow Toners 2–9 were prepared in the same manner as in Comparative Examples 1–8, respectively, except that a yellow colorant (C.I. Pigment Yellow 173) was used instead of the phthalocyanine pigment. The properties thereof are also shown in Table 3.

EXAMPLE 4

Magenta Toner 1 was prepared in the same manner as in Example 1 except that a magenta colorant (C.I. Pigment Red 122) was used instead of the phthalocyanine pigment. The properties thereof are shown in Table 4.

Comparative Examples 25–32

Magenta Toners 2–9 were prepared in the same manner as in Comparative Examples 1–8, respectively, except that a magenta colorant (C.I. Pigment Red 122) was used instead of the phthalocyanine pigment. The properties thereof are also shown in Table 4.

EXAMPLE 5

Black Toner 1 was prepared in the same manner as in Example 1 except that a black colorant (carbon black) was used instead of the phthalocyanine pigment. The properties thereof are shown in Table 5.

Comparative Examples 33–40

Black Toners 2–9 were prepared in the same manner as in Comparative Examples 1–8, respectively, except that a black colorant (carbon black) was used instead of the phthalocyanine pigment. The properties thereof are also shown in Table 5.

TABLE 3

| | Yellow toner | $G'_{60}$ (dyn/cm²) | $G'_{80}$ (dyn/cm²) | $G'_{60}/G'_{80}$ | $G'_{155}$ (dyn/cm²) | $G'_{190}$ (dyn/cm²) | $G'_{155}/G'_{190}$ | $G''_{40}$ (dyn/cm²) |
|---|---|---|---|---|---|---|---|---|
| Ex. 3 | 1 | $7.2 \times 10^8$ | $3.6 \times 10^6$ | 200.0 | $1.3 \times 10^4$ | $3.7 \times 10^3$ | 3.5 | $1.1 \times 10^9$ |
| Comp. Ex. | | | | | | | | |
| 17 | 2 | $9.1 \times 10^7$ | $3.8 \times 10^6$ | 23.9 | — | — | — | $6.8 \times 10^8$ |
| 18 | 3 | $8.2 \times 10^7$ | $4.4 \times 10^6$ | 18.6 | $1.8 \times 10^4$ | $2.0 \times 10^3$ | 9.0 | $6.1 \times 10^8$ |
| 19 | 4 | $1.2 \times 10^9$ | $2.0 \times 10^7$ | 60.0 | $6.0 \times 10^4$ | $5.6 \times 10^4$ | 1.1 | $1.2 \times 10^9$ |
| 20 | 5 | $6.3 \times 10^9$ | $9.3 \times 10^7$ | 67.7 | $3.7 \times 10^4$ | $5.6 \times 10^3$ | 6.6 | $1.1 \times 10^9$ |
| 21 | 6 | $2.0 \times 10^8$ | $2.9 \times 10^6$ | 69.0 | $5.6 \times 10^3$ | $8.9 \times 10^2$ | 6.3 | $7.5 \times 10^8$ |
| 22 | 7 | $7.5 \times 10^8$ | $1.5 \times 10^6$ | 50.0 | $5.4 \times 10^4$ | $3.9 \times 10^4$ | 1.4 | $1.2 \times 10^9$ |
| 23 | 8 | $2.4 \times 10^8$ | $3.7 \times 10^6$ | 64.9 | $8.5 \times 10^3$ | $9.0 \times 10^2$ | 9.4 | $8.2 \times 10^8$ |
| 24 | 9 | $8.6 \times 10^8$ | $1.3 \times 10^7$ | 66.2 | $9.7 \times 10^3$ | $1.7 \times 10^3$ | 5.7 | $9.2 \times 10^8$ |

TABLE 3-continued

| | $G''_{max}$ (dyn/cm$^2$)/°C. | tan (δ) max/°C. | $D_4$ (μm) | SF-1 | $THF_{ins}$ (wt. %) | Binder resin GPC peak or shoulder molecular weight** (×10$^4$) Main peak | Sub-peak or shoulder ≧ 10$^5$ | Dag* (%) | Anti-block |
|---|---|---|---|---|---|---|---|---|---|
| Ex. 3 | 1.9 × 10$^9$/50.5 | 3.1/68 | 6.3 | 106 | 10.3 | 2.1 | 13 (S), 115 (S) | 4.5 | A |
| Comp. Ex. | | | | | | | | | |
| 17 | — | 1.5/77 | 6.4 | 105 | 0 | 1.9 | — | 66.0 | D |
| 18 | — | 2.1/83 | 6.3 | 104 | 9.9 | 2.0 | 12 (S), 120 (S) | 43.0 | D |
| 19 | 2.4 × 10$^9$/67 | 2.8/75 | 7.5 | 133 | 10.7 | 2.3 | 15 (S), 110 (S) | 25.0 | C |
| 20 | 1.9 × 10$^9$/66 | 2.9/73 | 6.2 | 104 | 11.3 | 2.2 | 14 (S), 115 (S) | 4.1 | A |
| 21 | — | 1.8/63 | 7.8 | 135 | 6.5 | 1.8 | 13 (S), 120 (S) | 38.0 | C |
| 22 | 2.1 × 10$^9$/55 | 2.1/75 | 6.5 | 104 | 45.0 | 3.3 | 27 (S) | 6.6 | A |
| 23 | — | 1.6/65 | 7.4 | 166 | 0 | 2.1 | 78 (S) | 58.0 | C |
| 24 | 9.9 × 10$^8$/50 | 2.0/67 | 7.5 | 168 | 0 | 2.1 | 76 (S) | 40.0 | C |

TABLE 4

| | Magenta toner | $G'_{60}$ (dyn/cm$^2$) | $G'_{80}$ (dyn/cm$^2$) | $G'_{60}/G'_{80}$ | $G'_{155}$ (dyn/cm$^2$) | $G'_{190}$ (dyn/cm$^2$) | $G'_{155}/G'_{190}$ | $G''_{40}$ (dyn/cm$^2$) |
|---|---|---|---|---|---|---|---|---|
| Ex. 4 | 1 | 6.9 × 10$^8$ | 3.3 × 10$^6$ | 209.0 | 1.1 × 10$^4$ | 3.5 × 10$^3$ | 3.1 | 1.1 × 10$^9$ |
| Comp. Ex. | | | | | | | | |
| 25 | 2 | 9.0 × 10$^7$ | 3.5 × 10$^6$ | 25.7 | — | — | — | 6.0 × 10$^8$ |
| 26 | 3 | 8.3 × 10$^7$ | 4.0 × 10$^6$ | 20.8 | 1.4 × 10$^4$ | 1.8 × 10$^3$ | 7.8 | 6.4 × 10$^8$ |
| 27 | 4 | 1.3 × 10$^9$ | 1.9 × 10$^7$ | 68.4 | 5.8 × 10$^4$ | 5.3 × 10$^4$ | 1.1 | 1.0 × 10$^9$ |
| 28 | 5 | 6.6 × 10$^9$ | 1.0 × 10$^7$ | 660.0 | 3.7 × 10$^4$ | 5.6 × 10$^3$ | 6.6 | 1.3 × 10$^9$ |
| 29 | 6 | 2.0 × 10$^8$ | 2.7 × 10$^6$ | 74.0 | 5.6 × 10$^3$ | 8.5 × 10$^2$ | 6.6 | 7.5 × 10$^8$ |
| 30 | 7 | 7.9 × 10$^8$ | 1.5 × 10$^7$ | 51.3 | 5.5 × 10$^4$ | 3.7 × 10$^4$ | 1.5 | 1.3 × 10$^9$ |
| 31 | 8 | 2.6 × 10$^8$ | 3.6 × 10$^6$ | 72.2 | 8.0 × 10$^3$ | 8.9 × 10$^2$ | 9.0 | 8.0 × 10$^8$ |
| 32 | 9 | 8.7 × 10$^8$ | 1.4 × 10$^7$ | 62.1 | 9.5 × 10$^3$ | 1.3 × 10$^3$ | 7.3 | 8.9 × 10$^8$ |

| | $G''_{max}$ (dyn/cm$^2$)/°C. | tan (δ) max/°C. | $D_4$ (μm) | SF-1 | $THF_{ins}$ (wt. %) | Binder resin GPC peak or shoulder molecular weight** (×10$^4$) Main peak | Sub-peak or shoulder ≧ 10$^5$ | Dag* (%) | Anti-block |
|---|---|---|---|---|---|---|---|---|---|
| Ex. 4 | 1.9 × 10$^{4/50}$ | 3.3/68 | 6.0 | 103 | 7.6 | 2.3 | 16 (S), 100 (S) | 6.1 | A |
| Comp. Ex. | | | | | | | | | |
| 25 | — | 1.5/78 | 6.1 | 105 | 0 | 1.9 | — | 63.0 | D |
| 26 | — | 2.2/80 | 6.2 | 104 | 5.8 | 2.15 | 17 (S), 105 (S) | 39.0 | D |
| 27 | 2.4 × 10$^9$/67 | 2.8/75 | 7.6 | 132 | 9.1 | 2.1 | 18 (S), 100 (S) | 30.0 | C |
| 28 | 2.1 × 10$^9$/65 | 2.9/72 | 6.5 | 103 | 10.5 | 2.2 | 14 (S), 110 (S) | 5.4 | A |
| 29 | — | 1.9/65 | 8.0 | 135 | 6.7 | 1.8 | 15 (S), 120 (S) | 38.0 | C |
| 30 | 1.9 × 10$^9$/54 | 2.2/74 | 6.4 | 105 | 44.0 | 3.25 | 32 (S) | 6.0 | A |
| 31 | — | 1.6/63 | 7.3 | 164 | 0 | 2.2 | 80 (S) | 59.0 | C |
| 32 | 9.5 × 10$^8$/47 | 2.0/68 | 7.1 | 162 | 0 | 2.2 | 82 (S) | 41.0 | C |

TABLE 5

| | Black toner | $G'_{60}$ (dyn/cm$^2$) | $G'_{80}$ (dyn/cm$^2$) | $G'_{60}/G'_{80}$ | $G'_{155}$ (dyn/cm$^2$) | $G'_{190}$ (dyn/cm$^2$) | $G'_{155}/G'_{190}$ | $G''_{40}$ (dyn/cm$^2$) |
|---|---|---|---|---|---|---|---|---|
| Ex. 5 | 1 | 6.8 × 10$^8$ | 3.2 × 10$^6$ | 213.0 | 1.4 × 10$^4$ | 3.7 × 10$^3$ | 3.8 | 1.1 × 10$^9$ |
| Comp. Ex. | | | | | | | | |
| 33 | 2 | 9.3 × 10$^7$ | 3.9 × 10$^6$ | 25.8 | — | — | — | 6.2 × 10$^8$ |
| 34 | 3 | 8.0 × 10$^7$ | 4.5 × 10$^6$ | 17.8 | 1.5 × 10$^4$ | 2.4 × 10$^3$ | 6.3 | 6.0 × 0$^8$ |
| 35 | 4 | 1.9 × 10$^9$ | 2.5 × 10$^7$ | 76.0 | 6.0 × 10$^4$ | 5.8 × 10$^4$ | 1.0 | 1.3 × 10$^9$ |
| 36 | 5 | 7.0 × 10$^9$ | 9.5 × 10$^6$ | 73.7 | 3.9 × 10$^4$ | 5.1 × 10$^3$ | 7.6 | 1.1 × 10$^9$ |
| 37 | 6 | 2.0 × 10$^8$ | 2.7 × 10$^6$ | 74.1 | 5.0 × 10$^3$ | 8.0 × 10$^2$ | 7.1 | 6.9 × 10$^8$ |
| 38 | 7 | 8.0 × 10$^8$ | 1.5 × 10$^7$ | 53.3 | 5.5 × 10$^8$ | 3.1 × 10$^4$ | 1.8 | 1.3 × 10$^9$ |
| 39 | 8 | 2.5 × 10$^8$ | 4.0 × 10$^6$ | 62.5 | 8.6 × 10$^3$ | 9.5 × 10$^2$ | 9.1 | 8.1 × 10$^8$ |

TABLE 5-continued

| | | | | | | | | | |
|---|---|---|---|---|---|---|---|---|---|
| 40 | 9 | $8.9 \times 10^8$ | $1.5 \times 10^7$ | 59.3 | $1.0 \times 10^4$ | $1.8 \times 10^3$ | 5.6 | $9.5 \times 10^8$ | |
| | | | | | | Binder resin GPC peak or shoulder molecular weight** ($\times 10^4$) | | | |
| | $G''_{max}$ (dyn/cm$^2$)/°C. | tan (δ) max/°C. | $D_4$ (μm) | SF-1 | $THF_{ins}$ (wt. %) | Main peak | Sub-peak or shoulder ≧ $10^5$ | Dag* (%) | Anti-block |
| Ex. 5 | $1.9 \times 10^{9/51}$ | 3.4/67 | 6.1 | 103 | 5.8 | 2.0 | 15 (S), 120 (S) | 5.2 | A |
| Comp. Ex. | | | | | | | | | |
| 33 | — | 1.6/78 | 6.3 | 103 | 0 | 1.7 | — | 60.0 | D |
| 34 | — | 1.9/80 | 6.3 | 103 | 6.4 | 2.1 | 12 (S), 130 (S) | 42.0 | D |
| 35 | $2.2 \times 10^9$/66 | 2.7/78 | 7.7 | 137 | 7.2 | 1.95 | 14 (S), 110 (S) | 27.0 | C |
| 36 | $2.4 \times 10^9$/65 | 2.5/75 | 6.2 | 104 | 7.8 | 2.2 | 15 (S), 120 (S) | 4.8 | A |
| 37 | — | 2.0/64 | 7.5 | 108 | 4.0 | 1.8 | 14 (S), 110 (S) | 42.0 | C |
| 38 | $2.0 \times 10^9$/55 | 1.8/73 | 6.4 | 105 | 43.0 | 3.5 | 24 (S) | 6.3 | A |
| 39 | — | 1.8/62 | 7.4 | 165 | 0 | 2.15 | 83 (S) | 55.0 | C |
| 40 | $9.8 \times 10^9$/48 | 2.0/68 | 7.4 | 166 | 0 | 2.2 | 83 (S) | 34.0 | C |

EXAMPLE 6

Yellow Toner 1, Magenta Toner 1, Cyan Toner 1 and Black Toner 1 were charged in developing devices 4-1, 4-2, 4-3 and 4-4, respectively, and incorporated in the image forming apparatus similar to the one used in Example 1 to effect a full-color mode image forming test. The results are shown in Table 6.

Comparative Examples 41–48

Full-color image forming tests were performed in the same manner as in Example 6 except for using Yellow Toners 2–9, Magenta Toners 2–9, Cyan Toners 2–9 and Black Toners 2–9, respectively, in combination. The results are also shown in Table 6.

EXAMPLES 7–12

Cyan Toners 10–15 were prepared in the same manner as in Example 1 except for changing the species of polyester resin, the amount of divinylbenzene and the species of wax. The properties of the toner are shown in Table 7.

EXAMPLES 13–18

Image forming tests were performed in the same manner as in Example 2 except for using Cyan Toners 10–15, respectively, instead of Cyan Toner 1. The results are shown in Table 8.

TABLE 6

| | Toner | | | | Color- | Gloss | | $T_{FI}$ | $T_{HOFF}$ |
|---|---|---|---|---|---|---|---|---|---|
| | Yellow | Magenta | Cyan | Black | mixability* | at 160° C. | at 190° C. | (°C.) | (°C.) |
| Ex. 6 | 1 | 1 | 1 | 1 | A | 17 | 25 | 150 | 210 |
| Comp. Ex. | | | | | | | | | |
| 41 | 2 | 2 | 2 | 2 | A | 35 | — | 155 | 175 |
| 42 | 3 | 3 | 3 | 3 | A | 15 | 40 | 155 | 200 |
| 43 | 4 | 4 | 4 | 4 | C | — | 15 | 190 | 210 |
| 44 | 5 | 5 | 5 | 5 | C | 10 | — | 160 | 180 |
| 45 | 6 | 6 | 6 | 6 | A | 25 | 43 | 150 | 210 |
| 46 | 7 | 7 | 7 | 7 | C | — | 10 | 190 | 220 |
| 47 | 8 | 8 | 8 | 8 | A | 18 | 48 | 150 | 190 |
| 48 | 9 | 9 | 9 | 9 | B | 10 | — | 160 | 180 |

*Color-mixing characteristic was evaluated at three level by comparison with the original image by eye observation:
A: good,
B: average,
C: poor.

TABLE 7

| Ex. | Cyan toner | $G'_{60}$ (dyn/cm$^2$) | $G'_{80}$ (dyn/cm$^2$) | $G'_{60}/G'_{80}$ | $G'_{155}$ (dyn/cm$^2$) | $G'_{190}$ (dyn/cm$^2$) | $G'_{155}/G'_{190}$ | $G''_{40}$ (dyn/cm$^2$) |
|---|---|---|---|---|---|---|---|---|
| 7 | 10 | $3.9 \times 10^8$ | $2.8 \times 10^6$ | 140 | $1.5 \times 10^4$ | $4.0 \times 10^3$ | 3.8 | $1.1 \times 10^9$ |
| 8 | 11 | $3.5 \times 10^{10}$ | $1.0 \times 10^8$ | 350 | $1.0 \times 10^4$ | $4.2 \times 10^3$ | 2.4 | $9.9 \times 10^8$ |
| 9 | 12 | $3.0 \times 10^{10}$ | $1.2 \times 10^8$ | 250 | $3.8 \times 10^4$ | $3 \times 10^4$ | 1.3 | $1.3 \times 10^9$ |
| 10 | 13 | $5.3 \times 10^9$ | $2.9 \times 10^7$ | 180 | $2.5 \times 10^4$ | $7.8 \times 10^3$ | 3.2 | $1.2 \times 10^9$ |
| 11 | 14 | $8.2 \times 10^8$ | $6.6 \times 10^6$ | 125 | $4.7 \times 10^4$ | $1.0 \times 10^4$ | 4.7 | $1.1 \times 10^9$ |
| 12 | 15 | $4.6 \times 10^8$ | $2.5 \times 10^6$ | 185 | $4.9 \times 10^3$ | $1.0 \times 10^3$ | 4.9 | $1.0 \times 10^9$ |

| Ex. | $G''_{max}$ (dyn/cm$^2$)/°C. | tan (δ) max/°C. | $D_4$ (μm) | SF-1 | $THF_{ins}$ (wt. %) | Binder resin GPC peak or shoulder molecular weight** ($\times 10^4$): Main peak | Sub-peak or shoulder ≧ $10^5$ | Dag* (%) | Anti-block |
|---|---|---|---|---|---|---|---|---|---|
| 7 | $2.2 \times 10^9$/55 | 3.5/74 | 5.9 | 102 | 15.0 | 2.5 | 50 (S) | 13.0 | B |
| 8 | $1.8 \times 10^9$/58 | 3.1/65 | 6.2 | 107 | 3.0 | 1.5 | 35 (S) | 18.0 | B |
| 9 | $2.7 \times 10^9$/61 | 3.3/75 | 6.8 | 105 | 20.0 | 2.8 | 25 (S), 100 (S) | 9.8 | A |
| 10 | $1.9 \times 10^9$/53 | 1.3/80 | 6.6 | 113 | 18.0 | 2.3 | 14 (S), 110 (S) | 3.1 | A |
| 11 | $2.5 \times 10^9$/62 | 3.0/78 | 6.5 | 110 | 25.0 | 2.9 | 50 (S) | 7.8 | A |
| 12 | $1.6 \times 10^9$/65 | 3.2/68 | 6.7 | 105 | 0.5 | 2.5 | 25 (S), 100 (S) | 5.6 | A |

TABLE 8

| Ex. | Cyan toner | Image density: Initial | Image density: After 5000 sheets | Fog: Initial | Fog: After 5000 sheets | $T_{FI}$* (°C.) | $T_{H.OFF}$* (°C.) | Gloss of final image: at 160° C. | Gloss of final image: at 190° C. | Soiling within developing drive: Toner appln. roller | Developing sleeve | Elastic blade |
|---|---|---|---|---|---|---|---|---|---|---|---|---|
| 13 | 10 | 1.53 | 1.45 | 1.0 | 1.8 | 145 | 210 | 13 | 20 | A | A | A |
| 14 | 11 | 1.56 | 1.38 | 1.5 | 2.3 | 145 | 200 | 14 | 25 | A | B | B |
| 15 | 12 | 1.58 | 1.52 | 0.7 | 1.0 | 145 | 220 | 8 | 15 | A | A | A |
| 16 | 13 | 1.53 | 1.57 | 0.5 | 0.8 | 155 | 210 | 10 | 25 | A | A | A |
| 17 | 14 | 1.45 | 1.50 | 1.2 | 2.4 | 155 | 220 | 7 | 12 | A | A | A |
| 18 | 15 | 1.56 | 1.54 | 0.8 | 1.2 | 140 | 200 | 10 | 25 | A | A | A |

EXAMPLE 19

| | |
|---|---|
| Styrene monomer | 180 wt. parts |
| n-Butyl acrylate monomer | 20 wt. parts |
| Yellow pigment (Pigment Yellow) | 18 wt. parts |
| Saturated polyester resin | 10 wt. parts |
| Dialkylsalicylic acid chromium compound | 2 wt. parts |
| Divinylbenzene | 0.3 wt. parts |
| Tetraethylene glycol dimethacrylate | 0.2 wt. parts |
| Ester wax (Tmp = 74° C., $W_{1/2}$ = 4° C.) | 30 wt. parts |

The above ingredients were subjected to dispersion for 3 hours by an attritor, and then 5 wt. parts of 2,2'-azobisisobutyronitrile (polymerization initiator) was added thereto to formulate a polymerizable monomer composition, which was then charged into an aqueous medium at 60° C. comprising 1200 wt. parts of water and 7 wt. parts of sodium polyacrylate and subjected to formation of particles under stirring for 15 min. by a TK-type homomixer at 12,000 rpm. Then, the homomixer was replaced by a propeller stirring blade, and the system temperature was increased to 70° C. for 10 hours of polymerization under stirring at 60 rpm. The polymerizate particles in suspension showed a weight-average particle size ($D_4$) of 1 μm.

Then, while the suspension liquid was stirred, the pH thereof was adjusted to 4.6 and the temperature was adjusted at 85° C. The pH and the temperature were maintained for 7 hours to effect association of the particles. The resultant particles were washed with water and dried to obtain yellow toner particles having a weight-average particle size ($D_4$) of 6.1 μm. As a result of microscopic observation, the toner particles showed a sea-island structure including a low-softening point substance (A) dispersed within and coated with an outer shell resin (B) as shown in FIG. 8.

100 wt. parts of the yellow toner particles and 1.5 wt. parts of titanium oxide fine powder were blended by a Henschel mixer to obtain Yellow Toner 10.

EXAMPLE 20

| | |
|---|---|
| Styrene monomer | 170 wt. parts |
| n-Butyl acrylate monomer | 30 wt. parts |
| Magenta pigment (Permanent Red) | 13 wt. parts |
| Unsaturated polyester resin | 7 wt. parts |
| Dialkyisalicylic acid aluminum compound | 2 wt. parts |
| Divinylbenzene | 0.2 wt. parts |
| Polyethylene wax (Tmp = 128° C., $W_{1/2}$ = 38° C.) | 1 wt. parts |
| Ester wax. (Tmp = 72° C., $W_{1/2}$ = 5° C.) | 19 wt. parts |

The above ingredients were subjected to dispersion for 3 hours by an attritor, and then 4.5 wt. parts of 2,2'-azobis-2,4-dimethylvaleronitrile (polymerization initiator) was added thereto to formulate a polymerizable monomer composition, which was then charged into an aqueous medium at 65° C. comprising 1200 wt. parts of water and 8 wt. parts of tricalcium phosphate and subjected to formation of particles under stirring for 9 min. by a TK-type homomixer at 9,000 rpm. Then, the homomixer was replaced by a propeller stirring blade, which was stirred at 70 rpm for 9 hours of polymerization. After completion of the polymerization, dilute hydrochloric acid was added to the system to remove the calcium phosphate. Then, the polymerizate was washed and dried to obtain magenta toner particles having a weight-average particle size ($D_4$)=6.2 μm.

100 wt. parts of the magenta toner particles and 1.5 wt. parts of titanium oxide fine powder were blended by a Henschel mixer to obtain Magenta Toner 10.

EXAMPLE 21

| | |
|---|---|
| Styrene monomer | 195 wt. parts |
| n-Butyl acrylate monomer | 5 wt. parts |
| Magenta pigment (permanent Red) | 19 wt. parts |
| Low-molecular weight polyester | 10 wt. parts |
| Dialkylsalicylic acid aluminum compound | 2 wt. parts |
| Divinylbenzene | 1.5 wt. parts |
| Ester wax (Tmp = 79° C., $W_{1/2}$ = 3° C.) | 20 wt. parts |

The above ingredients were subjected to dispersion for 3 hours by an attritor, and then 3 wt. parts of lauroyl peroxide (polymerization initiator) was added thereto to formulate a polymerizable monomer composition, which was then charged into an aqueous medium at 70° C. comprising 1200 wt. parts of water and 7 wt. parts of tricalcium phosphate and subjected to formation of particles under stirring for 8 min. by a TK-type homomixer at 10,000 rpm. Then, the homomixer was replaced by a propeller stirring blade, which was stirred at 60 rpm for 10 hours of polymerization. After completion of the polymerization, dilute hydrochloric acid was added to the system to remove the calcium phosphate. Then, the polymerizate was washed and dried to obtain magenta toner particles having a weight-average particle size ($D_4$)=6.7 μm.

100 wt. parts of the magenta toner particles and 1.5 wt. parts of titanium oxide fine powder were blended by a Henschel mixer to obtain Magenta Toner 11.

EXAMPLE 22

| | |
|---|---|
| Styrene monomer | 145 wt. parts |
| n-Butyl acrylate monomer | 55 wt. parts |
| Phthalocyanine pigment | 14 wt. parts |
| Saturated polyester resin | 10 wt. parts |
| Dialkylsalicylic acid aluminum compound | 2 wt. parts |
| Divinylbenzene | 1.3 wt. parts |
| Tetraethylene glycol dimethacrylate | 0.2 wt. parts |
| Ester wax (Tmp = 81° C., $W_{1/2}$ = 5° C.) | 30 wt. parts |

The above ingredients were subjected to dispersion for 3 hours by an attritor, and then 5 wt. parts of 2,2'-azobisisobutyronitrile (polymerization initiator) was added thereto to formulate a polymerizable monomer composition, which was then charged into an aqueous medium at 60° C. comprising 1200 wt. parts of water and 7 wt. parts of sodium polyacrylate and subjected to formation of particles under stirring for 15 min. by a TK-type homomixer at 12,000 rpm. Then, the homomixer was replaced by a propeller stirring blade, and the system temperature was increased to 75° C. for 10 hours of polymerization under stirring at 60 rpm. The polymerizate particles in suspension showed a weight-average particle size of 1 μm. Then, while the suspension liquid was stirred, the pH thereof was adjusted to 4.6 and the temperature was adjusted at 85° C. The pH and the temperature were maintained for 7 hours to effect association of the particles. The resultant particles were washed with water and dried to obtain cyan toner particles having a weight-average particle size ($D_4$) of 6.2 μm.

100 wt. parts of the cyan toner particles and 1.5 wt. parts of titanium oxide fine powder were blended by a Henschel mixer to obtain Cyan Toner 16.

EXAMPLE 23

| | |
|---|---|
| Styrene monomer | 165 wt. parts |
| n-Butyl acrylate monomer | 35 wt. parts |
| Phthalocyanine pigment | 14 wt. parts |
| Low-molecular weight polyester | 10 wt. parts |
| Dialkylsalicylic acid chromium compound | 2 wt. parts |
| Divinylbenzene | 1.5 wt. parts |
| Amide wax (Tmp = 105° C., $W_{1/2}$ = 30° C.) | 30 wt. parts |

The above ingredients were subjected to dispersion for 3 hours by an attritor, and then 3 wt. parts of lauroyl peroxide (polymerization initiator) was added thereto to formulate a polymerizable monomer composition, which was then charged into an aqueous medium at 70° C. comprising 1200 wt. parts of water and 10 wt. parts of tricalcium phosphate and subjected to formation of particles under stirring for 12 min. by a TK-type homomixer at 10,000 rpm. Then, the homomixer was replaced by a propeller stirring blade, which was stirred at 60 rpm for 10 hours of polymerization. After completion of the polymerization, dilute hydrochloric acid was added to the system to remove the calcium phosphate. Then, the polymerizate was washed and dried to obtain cyan toner particles having a weight-average particle size ($D_4$)= 6.4 μm.

100 wt. parts of the cyan toner particles and 1.5 wt. parts of titanium oxide fine powder were blended by a Henschel mixer to obtain Cyan Toner 17.

The toners of Examples 19–23 above (together with those obtained in Comparative Examples 49–53 described hereinafter) were subjected to the following fixing test and gloss test, and the evaluation results together with some physical properties are shown in Table 9 below with respect to various items of which the evaluation standards are supplemented below Table 9.

Fixing test

In order to evaluate the low-temperature fixability of a toner, a fixing device of a digital copying machine ("GP-55", made by Canon K.K.) was taken out and re-modeled to be equipped with an external driver and a temperature controller so as to rotate the fixing rollers at a process speed of 50 mm/sec and control the fixing roller temperature in the range of 100°–250° C. The fixing test was performed in a thermostatic chamber controlled at a temperature of 3°–5° C. After confirming that the fixing rollers reached the chamber temperature, a power was supplied, and a fixing test was performed immediately after the heating roller (upper roller) reached 110° C. At this point of time, the pressure roller (lower roller) was at ca. 70° C. Then, while the heater was energized, the fixing rollers were rotated for 20 min., and then a fixing test was performed. At this time, the pressure roller temperature was ca. 90° C.

Gloss test

In order to evaluate the gloss stability of a toner, a fixed image sample at a fixing temperature of 155° C. was observed with eyes for evaluating a gloss lowering between ends and a difference from a fixed image sample at 190° C. Further, each toner was subjected to a continuous image forming test on 10,000 sheets by using a commercially available copying machine ("FC-330", made by Canon K.K.) together with a process cartridge (apparatus unit) for non-magnetic mono-component development, whereby a degree of gloss change between an average gloss value at an initial stage (on first to tenth sheets) and a gloss value at the end of continuous forming test was recorded.

TABLE 9

| | Examples | | | | |
|---|---|---|---|---|---|
| Test item | 19 | 20 | 21 | 22 | 23 |
| $G'_{60}/G'_{80}$ | 145 | 122 | 81 | 150 | 80 |
| $G'_{155}/G'_{190}$ | 1.2 | 1.1 | 1.1 | 1.4 | 1.2 |
| Tc (°C.) | 68 | 69 | 87 | 38 | 61 |
| 1) Fixability at 110° C. | A | A | C | A | B |
| 2) Gloss lowering | A | A | A | A | A |
| 3) Gloss difference | A | A | A | A | A |
| 4) Gloss change rate | A | A | A | A | A |
| Anit-blocking | B | B | B | C | B |

[Notes of Tables 9 and 10]

1) Fixability at 110° C.

Fixed images were rubbed two times (one reciprocation) with a lens cleaning paper ("dasper" available from Ozu Paper Co. Ltd.) under a load of 50 g/cm$^2$, and a lowering in image density due to the rubbing was recorded for each fixed image. The above fixing test was performed for a fixed image obtained immediately after the heating roller reached 110° C. and for a fixed image obtained after 20 minutes of blank rotation of the fixing rollers for each toner sample to measure a change in lowered image density. For a series of sample toners (Examples 19–23 and Comparative Examples 37–41), the above test was preformed, and the maximum change of a sample among the samples was taken as the standard (100%). The other samples were rated at four ranks of A–D based on the relative change as follows:

A: 0% to below 25%,

B: 25% to below 50%,

C: 50% to below 75%,

D: 75% to 100%.

A smaller value of the relative change means a smaller change between a density lowering between the fixed image obtained immediately after the heating roller temperature has reached 110° C. and the fixed image obtained after 20 min. of blank rotation, i.e., showing a good fixability (a toner's own fixability) from the initial stage after a power supply to the image forming apparatus.

2) Gloss lowering

A gloss lowering between a leading end and a trailing end of a fixed image sample was measured, and the largest lowering among the samples was taken as the standard (100%), and the other samples were rated according to the following standard based on a relative gloss lowering:

A: 0% to below 25%,

B: 25% to below 50%,

C: 50% to below 75%,

D: 75% to 100%.

A smaller value means an image having a more uniform gloss.

3) Gloss difference

A gloss difference between a fixed image sample at 155° C. and a fixed image sample at 190° C. was measured for each toner sample, and largest difference among the toner samples was taken as the standard (100%), and the other toner samples were rated according to the following standard based on a relative gloss difference.

A: 0% to below 25%,

B: 25% to below 50%,

C: 50% to below 75%,

D: 75% to 100%.

A smaller value means a smaller temperature-dependent gloss change.

4) Gloss change rate

An average gloss value of initial fixed images (on 1st to 10th sheets) and a gloss value of a fixed image at the end of a continuous image forming test on 10000 sheets for each toner sample were measured to record a gloss difference therebetween. The largest gloss difference among the toner samples was taken as the standard (100%), and the other toner samples were rated according to the following standard based on a relative gloss difference:

A: 0% to below 25%,

B: 25% to below 50%,

C: 50% to below 75%,

D: 75% to 100%.

A smaller value means a smaller gloss change between the initial stage and the last stage of a continuous image forming test.

Comparative Example 49

A yellow toner having a weight-average particle size of 6.5 μm was prepared in the same manner as in Example 19 except for omitting the divinylbenzene used in Example 19.

Comparative Example 50

A yellow toner having a weight-average particle size of 6.6 μm was prepared in the same manner as in Example 19 except for using polypropylene wax (Tmp=143° C., $W_{1/2}$= 30° C.) instead of the ester wax used in Example 19.

Comparative Example 51

A yellow toner having a weight-average particle size of 6.4 μm was prepared in the same manner as in Example 19 except for omitting the divinylbenzene and replacing the ester wax with polypropylene wax (Tmp=146° C., $W_{1/2}$=33° C.).

Comparative Example 52

A yellow toner having a weight-average particle size of 6.9 μm was prepared in the same manner as in Example 19 except for omitting the divinylbenzene and tetraethylene glycol dimethacrylate used in Example 19.

Comparative Example 53

A magenta toner having a weight-average particle size of 6.6 μm was prepared in the same manner as in Example 20 except for omitting the divinylbenzene and replacing the unsaturated polyester with saturated polyester.

The toners of Comparative Examples 49–53 were evaluated along with the toners of Examples 19–23, and the results thereof are shown in Table 10 below.

TABLE 10

| | Comparative Examples | | | | |
|---|---|---|---|---|---|
| Test item | 49 | 50 | 51 | 52 | 53 |
| $G'_{60}/G'_{80}$ | 101 | 71 | 74 | 80 | 114 |
| $G'_{155}/G'_{190}$ | 18 | 1.05 | 9.5 | 22 | 26 |
| Tc (°C.) | 58 | 61 | 60 | 66 | 71 |
| 1) Fixability at 110° C. | B | D | C | C | A |
| 2) Gloss lowering | D | A | C | D | D |
| 3) Gloss difference | D | A | C | D | D |
| 4) Gloss change rate | D | A | C | D | D |
| Anit-blocking | C | B | B | B | B |

What is claimed is:

1. A toner for developing an electrostatic image, comprising:

100 wt. parts of a binder resin, 1–150 wt. parts of a colorant and 5–40 wt. parts of a low-softening point substance;

wherein the toner has a storage modulus at 60° C. ($G'_{60}$) and a storage modulus at 80° C. ($G'_{80}$) providing a ratio ($G'_{60}/G'_{80}$) of at least 80, and a storage modulus at 155° C. ($G'_{155}$) and a storage modulus at 190° C. ($G'_{190}$) providing a ratio ($G'_{155}/G'_{190}$) of 0.95–5; and wherein the binder resin comprises a crosslinked styrene copolymer and a non-crosslinked or crosslinked polyester resin, and the low-softening point substance has a DSC heat-absorption curve showing a heat-absorption main peak in a temperature range of 40°–90° C.

2. The toner according to claim 1, wherein the toner shows a ratio ($G'_{60}/G'_{80}$) of 100–400.

3. The toner according to claim 1, wherein the toner shows a ratio ($G'_{60}/G'_{80}$) of 150–300.

4. The toner according to claim 1, wherein the toner shows a ratio ($G'_{155}/G'_{190}$) of 1–5.

5. The toner according to claim 1, wherein the toner has a storage modulus at 190° C. ($G'_{190}$) of $1\times10^3$–$1\times10^4$ dyn/cm$^2$.

6. The toner according to claim 1, wherein the toner provides a loss modulus curve giving a maximum ($G''_{max}$) of at least $1\times10^9$ dyn/cm$^2$ in a temperature range of 40°–65° C.

7. The toner according to claim 6, wherein the toner shows a loss modulus at 40° C. of $G''_{40}$ giving a ratio ($G''_{max}/G''_{40}$) of at least 1.5.

8. The toner according to claim 1, wherein the binder resin has a THF-insoluble content of 0.1–20 wt. %.

9. The toner according to claim 8, wherein the binder resin has a THF-insoluble content of 1–15 wt. %.

10. The toner according to claim 1, wherein the low-softening point substance provides a DSC heat-absorption curve showing a heat-absorption main peak in a temperature range of 45°–85° C., the heat-absorption main peak having a half-value width of at most 10° C.

11. The toner according to claim 10, wherein the low-softening point substance shows a heat-absorption main peak having a half-value width of at most 5° C.

12. The toner according to claim 1, wherein the low-softening point substance comprises a solid wax.

13. The toner according to claim 1, wherein the low-softening point substance comprises a solid ester wax.

14. The toner according to claim 1, wherein the low-softening point substance comprises a solid ester wax providing a DSC heat-absorption curve showing a heat-absorption main peak in a temperature range of 45°–85° C., the heat-absorption main peak having a half-value width of at most 10° C.

15. The toner according to claim 14, wherein the solid ester wax shows a heat-absorption main peak having a half-value width of at most 5° C.

16. The toner according to claim 1, wherein the low-softening point substance comprises a solid polymethylene wax providing a DSC heat-absorption peak showing a heat-absorption main in a temperature range of 40°–90° C., the heat-absorption peak having a half-value width of at most 10° C.

17. The toner according to claim 1, wherein the low-softening point substance comprises a solid polyolefin wax providing a DSC heat-absorption peak showing a heat-absorption main in a temperature range of 40°–90° C., the heat-absorption peak having a half-value width of at most 10° C.

18. The toner according to claim 1, wherein the low-softening point substance comprises a long-chain alkyl alcohol having 15–100 carbon atoms and providing a DSC heat-absorption peak showing a heat-absorption main in a temperature range of 40°–90° C., the heat-absorption peak having a half-value width of at most 10° C.

19. The toner according to claim 1, wherein the toner is in the form of toner particles containing 11–30 wt. % thereof of the low-softening point substance.

20. The toner according to claim 19, wherein the low-softening point substance is contained in 12–35 wt. part per 100 wt. parts of the binder resin.

21. The toner according to claim 1, wherein the toner is a non-magnetic cyan toner.

22. The toner according to claim 1, wherein the toner is a non-magnetic magenta toner.

23. The toner according to claim 1, wherein the toner is a non-magnetic yellow toner.

24. The toner according to claim 1, wherein the toner is a non-magnetic black toner.

25. The toner according to claim 1, having a shape factor SF-1 of 100–160.

26. The toner according to claim 1, having a shape factor SF-1 of 100–150.

27. The toner according to claim 1, having a shape factor SF-1 of 100–125.

28. The toner according to claim 1, prepared by the process of suspension polymerization.

* * * * *

UNITED STATES PATENT AND TRADEMARK OFFICE

CERTIFICATE OF CORRECTION

PATENT NO. : 5,753,399

DATED : May 19, 1998

INVENTOR(S): KENGO HAYASE ET AL.

It is certified that error appears in the above-identified patent and that said Letters Patent is hereby corrected as shown below:

ON COVER PAGE AT [54] IN THE TITLE

"NEW-CROSSLINKED" should read --NON-CROSSLINKED--.

COLUMN 1

Line 4, "NEW-CROSSLINKED" should read --NON-CROSSLINKED--;
Line 28, "above mentioned" should read --above-mentioned--.

COLUMN 4

Line 7, "develope" should read --develop--;
Line 22, "offset-presenting" should read --offset-preventing--.

COLUMN 5

Line 59, "$(G'_{60}/G_{80})$ should read --$(G'_{60}/G'_{80})$--.

COLUMN 10

Line 1, "naphtoic" should read --naphthoic--.

COLUMN 18

Line 21, "colorimage." should read --color image.--.

UNITED STATES PATENT AND TRADEMARK OFFICE

CERTIFICATE OF CORRECTION

PATENT NO. : 5,753,399

DATED : May 19, 1998

INVENTOR(S): KENGO HAYASE ET AL.

It is certified that error appears in the above-identified patent and that said Letters Patent is hereby corrected as shown below:

COLUMN 19

Line 38, "doe" should read --does--.

COLUMN 37

Table 9, "Anit-blocking" should read --Anti-blocking--.

COLUMN 39

Table 10, "Anit-blocking" should read --Anti-blocking--.

COLUMN 41

Line 2, "part" should read --parts--.

Signed and Sealed this

Ninth Day of February, 1999

*Attest:*

*Acting Commissioner of Patents and Trademarks*

*Attesting Officer*